US005569638A

United States Patent [19]

Shirai et al.

[11] Patent Number: 5,569,638

[45] Date of Patent: Oct. 29, 1996

[54] ROLL-TYPE HEAT TRANSFER IMAGE-RECEIVING SHEET

[75] Inventors: Koichi Shirai; Kazunobu Imoto; Satoshi Narita; Yoshinori Kamikubo; Mitsuhiro Hamashima, all of Tokyo-to, Japan

[73] Assignee: Dai Nippon Printing Co., Ltd., Japan

[21] Appl. No.: 493,172

[22] Filed: Jun. 21, 1995

[30] Foreign Application Priority Data

| | | | |
|---|---|---|---|
| Jun. 23, 1994 | [JP] | Japan | 6-164483 |
| Jul. 6, 1994 | [JP] | Japan | 6-177446 |
| Jul. 18, 1994 | [JP] | Japan | 6-187821 |
| Sep. 13, 1994 | [JP] | Japan | 6-244659 |
| Oct. 14, 1994 | [JP] | Japan | 6-276098 |

[51] Int. Cl.[6] ..... B41M 5/035; B41M 5/38

[52] U.S. Cl. ..... 503/227; 428/34.1; 428/34.2; 428/35.7; 428/36.5; 428/195; 428/504.4; 428/480; 428/913; 428/914

[58] Field of Search ..... 428/34.1, 34.2, 428/35.7, 36.5, 195, 304.4, 480, 913, 914; 503/227

[56] References Cited

U.S. PATENT DOCUMENTS 5,001,106 3/1991 Egashira et al. ..... 503/227

FOREIGN PATENT DOCUMENTS 2-22090 1/1990 Japan ..... 503/227

2-146046 12/1990 Japan ..... 503/227

*Primary Examiner*—B. Hamilton Hess

*Attorney, Agent, or Firm*—Parkhurst, Wendel & Burr, L.L.P.

[57] ABSTRACT

A roll-type heat transfer image-receiving sheet comprising a wind-up cylinder and a heat transfer image-receiving sheet which comprises at least a substrate and a coloring material-receiving layer provided thereon, the heat transfer image-receiving sheet being wound around the wind-up cylinder, wherein the maximum surface roughness of the wind-up cylinder in the longitudinal direction thereof is controlled to 40 micrometers or less; the wind-up cylinder is prepared by using pulp as a main component, and a cushioning material is provided between the wind-up cylinder and the heat transfer image-receiving sheet; a lead sheet is provided to the leading end of the heat transfer image-receiving sheet so that the image-receiving sheet can be easily led through a printer; and the heat transfer image-receiving sheet is wound around the wind-up cylinder with the coloring material-receiving sheet outside so that curl will not remain in the image-receiving sheet and that curl will not be developed during a printing process. An image free frost unevenness of density and voids can be produced on the image-receiving sheet without being affected by the roughness or difference in level present on the surface of the wind-up cylinder. The image-receiving sheet has stable transfer printing properties, and, in the roil of the image-receiving sheet, even a portion near the wind-up cylinder can be used and is not wasted.

36 Claims, 4 Drawing Sheets

ROLL-TYPE HEAT TRANSFER IMAGE-RECEIVING SHEET

BACKGROUND OF THE INVENTION

1. Field of the Invention

The present invention relates to a roll-type heat transfer image-receiving sheet which is brought into contact with a heat transfer image-printing sheet to thermally transfer therefrom a coloring material by means of a thermal heed to produce an image. More specifically, the present invention relates to a roll-type heat transfer image-receiving sheet for use in a heat transfer printing process in which a sublimable dye is used as a coloring material, on which sheet a full-colored, high-density recording image can be produced.

2. Related Art

Among various heat transfer recording processes, a sublimation-type transfer recording process has been well known. In this recording process, a sublimable dye used as a coloring material is transferred to an image-receiving sheet to produce an image thereon by the use of a thermal head which generates heat according to a recording signal. This recording process is characterized in that a dye is used as a coloring material, and that an image with gradation can be successfully produced. Therefore, an image obtained by this process is extremely sharp, and excellent in the reproduction of a half-tone color and of gradation. As image having quality comparable to that of a photograph developed by using a silver salt can thus be obtained by this process.

Thanks to the above-described advantageous properties and the recent progress in a variety of hardwares and softwares related to multi-media communication, the sublimation-type transfer recording process is rapidly extending its market as a full-color hard copy system for computer graphics, static images sent by means of satellite communication, digital images obtained from CO-ROM or the like, and analogue images produced by video recorders or the like.

Image-receiving sheets for use in the sublimation-type transfer recording process have a wide variety of practical uses. They are often used as sheets for proofs, and for the output printing of images, plans or designs drawn by the CAD/CAM system, and data obtained by a variety of medical analytical instruments such as a CT scanner or measuring devices. In addition, they are used as the substitution of instant photographs, for the printing of a photograph of face onto an ID card, a credit card or the like, and for the printing of composite or souvenir pictures taken at amusement facilities such as a recreation ground, a museum and an aquarium.

The heat transfer image-receiving sheet for sublimation-type transfer printing (hereinafter referred to as an image-receiving sheet), having various uses as described above is, in general, composed of a substrate and a coloring material-receiving layer provided thereon. Further, a laminate of a support and a layer containing therein microvoids is usually used as the substrate in order to attain high printing sensitivity.

When the layer containing microvoids is not provided, the resulting image-receiving sheet is poor in printing sensitivity, and an image produced thereon has unevenness of density.

Most of the conventional image-receiving sheets are in the form of sheet. Therefore, the selection of image-printing area ties been restricted by the size of the sheet.

However, in line with the recent extension of the market of the image-receiving sheet owing to the above-described diversified uses thereof, a demand for an image-receiving sheet in which an image-printing area can be freely selected is now growing.

The above demand can be set by changing the form of the image-receiving sheet from sheet to roll. A roll-type image-receiving sheet can have an increased image-printing area in the flow direction of the roll.

Further, there is also a strong demand for a cheaper image-receiving sheet. In the case of the sheet-type image-receiving sheet, it is necessary to cut a large image-receiving sheet into sheets of a predetermined size in the manufacturing process. It is therefore required to provide facilities for this purpose, and energy needed for operating the facilities has been the cause of an increase in the production cost.

This problem can also be solved, that is, the production cost can be reduced, by changing the form of an image-receiving sheet from sheet to roll.

However, a roll-type image-receiving sheet newly causes many other problems. Of these, one of the serious problems is such that the printing properties of the image-receiving sheet at the outer part of the roll (the outside of the roll) and those of the image-receiving sheet at the inner part of the coil (the core part of the roll), which is near the wind-up cylinder of the roll, are different from each other, and the image-receiving sheet at the inner part of the roll has unstable printing properties. For this reason, an image produced on such a part of the image-receiving sheet is to have unevenness of density.

To obtain a roll-type image-receiving sheet, an image-receiving sheet is wound around a wind-up cylinder, so that high pressure acts upon the portion of the image-receiving sheet which is near the core of the roll. Therefore, when the wind-up cylinder has a rough surface, the roughness affects such a portion of the image-receiving sheet to make the surface thereof rough. When an image is printed on the rough surface of the image-receiving sheet, unevenness of density and voids are produced therein.

In particular, when the roughness on the surface of the wind-up cylinder is not parallel to the main-scanning direction of a thermal heed, for example, in the case of a paper-made wind-up cylinder whose outermost surface is formed by pasting paper spirally, pressure applied by a platen roll or the like to the image-receiving sheet during a printing process cannot be parallel to the roughness on the surface of the cylinder. For this reason, an image obtained has voids and unevenness of density to a considerable degree.

Further, the same problem as the above may also be caused when the end of an image-receiving sheet is fixed to a wind-up cylinder by using one of various pressure-sensitive adhesive single coated tapes.

When pulp is used as a main component to prepare a wind-up cylinder, the problem accompanied by the disposal thereof is solved, and the handling of the cylinder can be made easier. On the other hand, it has been known to provide a foamed layer between the substrate and the image-receiving layer of an image-receiving sheet in order to obtain an image with decreased voids and unevenness of density.

However, when an image-receiving sheet containing a foamed layer is wound around a pulp-made wind-up cylinder, the foamed layer is destroyed due to the roughness on the surface of the wind-up cylinder, inherent to the texture of the paper used. Therefore, an image produced on such an image-receiving sheet tends to have unevenness of density.

Further, a cylinder prepared by spirally winding paper around a core is used as the pulp-made wind-up cylinder. The spiral pattern thus produced makes difference in level on the surface of the cylinder, so that there has also been a problem in that the foamed layer is destroyed by this difference in level.

Furthermore, when the end of a heat transfer image-receiving sheet is directly fixed to a wind-up cylinder, difference in level corresponding to the thickness of the image-receiving sheet is made at the portion where the image-receiving sheet is adhered to the wind-up cylinder. The foamed layer contained in several turns of the image-receiving sheet wound around the wind-up cylinder is destroyed due to this difference in level. Such a portion of the image-receiving sheet that is effected by the difference in level cannot be used, and is wasted.

SUMMARY OF THE INVENTION

An object of the present invention is to provide a roll-type heat transfer image-receiving sheet for use in heat transfer printing of sublimation-type or melt-type transfer recording process, on which an image free from unevenness of density and voids caused due to the roughness on the surface of the wind-up cylinder of the roll can be produced, which has stabilized heat transfer printing properties and in which even a portion positioned near the wind-up cylinder can be used and is not wasted.

According to the present invention, the above object can be attained by a roll-type heat transfer image-receiving sheet which comprises a wind-up cylinder and a heat transfer image-receiving sheet comprising at least a substrate and a coloring material-receiving layer provided thereon, the heat transfer image-receiving sheet being wound around the wind-up cylinder, the maximum surface roughness of the wind-up cylinder with respect to the longitudinal direction thereof being 40 micrometers or less.

By controlling the maximum surface roughness of the wind-up cylinder to the above specific value or less, such a portion of the image-receiving sheet that is near the core of the roll can be prevented from acquiring roughness even if pressure is applied thereto.

Further, the above object of the invention can also be attained by a roll-type heat transfer image-receiving sheet which comprises a wind-up cylinder and a heat transfer image-receiving sheet comprising at least a substrate, a foamed layer provided thereon, and a coloring material-receiving layer provided on the foamed layer, the heat transfer image-receiving sheet being wound around the wind-up cylinder, the wind-up cylinder being prepared by using pulp as a main component, a cushioning material being placed between the wind-up cylinder and the heat transfer image-receiving sheet.

An image produced on this image-receiving sheet is not affected by the roughness on the surface of the wind-up cylinder because the cushioning material is pieced between the wind-up cylinder and the heat transfer image-receiving sheet. Further, the cushioning material can reduce the difference in level which is made at the portion where the end of the image-receiving sheet is fixed to the wind-up cylinder.

DESCRIPTION OF THE PREFERRED EMBODIMENTS

By referring to the preferred embodiments, the heat transfer image-receiving sheet of the present invention will be explained in detail. The heat transfer image-receiving sheet of the invention can be used in the sublimation-type or hot-melt-type transfer printing process.

Figure 1:
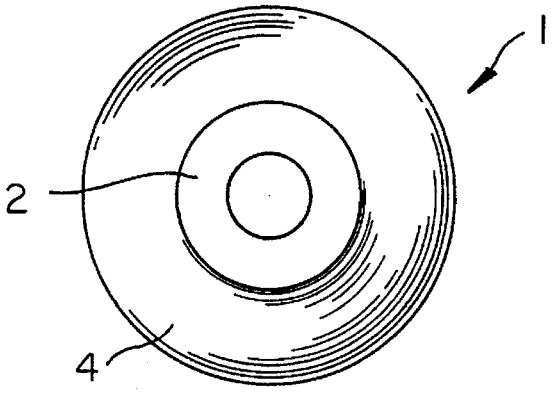
FIG. 1 in a side view of a roll-type heat transfer image-receiving sheet according to the present invention.
Figure 2:
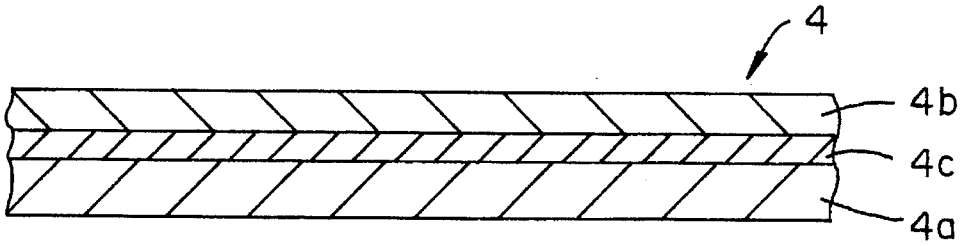
FIG. 2 is an enlarged cross-sectional view of a heat transfer image-receiving sheet.

As shown in FIG. 1, the roll-type heat transfer image-receiving sheet 1 of the present invention comprises a wind-up cylinder 2, and a heat transfer image-receiving sheet 4 wound around it. The image-receiving sheet 4 comprises, as shown in FIG. 2, at least a substrate **4*a* and a coloring material-receiving layer 4*b*. Further, according to the present invention, the maximum surface roughness of the wind-up cylinder 2** with respect to the longitudinal direction thereof (the direction of axis of rotation) is made to 40 micrometers or less.

Coloring Material-Receiving Layer

The coloring material-receiving layer **4*b*** is formed by the use of a varnish containing as a main component a resin which can be readily dyed with a coloring material, and various additives such as a releasing agent which are added thereto when necessary. Examples of the resin which can be readily dyed include polyolefin resins such as polypropylene, halogenated teeing such as polyvinyl chloride and polyvinylidene chloride, vinyl resins such as polyvinyl acetate and polyacrylate, and copolymers thereof, polyester resins such as polyethylene terephthalate and polybutylene terephthalate, polystyrene resins, polyamide resins, copolymers of an olefin such as ethylene or propylene and other vinyl monomer, ionomers, and cellulose derivatives. These resins can be used either singly or in combination. Of these, polyester resins and vinyl resins are preferred.

A releasing agent say be incorporated into the coloring material-receiving layer in order to prevent thermal fusion between the heat transfer image-receiving sheet and a heat transfer image-printing sheet, caused when an image is printed. Silicone oil, a phosphoric ester-based plasticizer or a fluorine-containing compound can be used as the releasing agent. Of these, silicone oil is preferred. The amount of the releasing agent to be incorporated is preferably from 0.2 to 30 parts by weight of the resin used for forming the coloring material-receiving layer. Other additives such as a fluorescent whitening agent may also be added to the coloring material-receiving layer as needed.

The coloring material-receiving layer is formed by coating a coating liquid for forming the layer by a conventional method such as the roll coating, bar coating, gravure coating or gravure reverse coating method. The amount of the coating liquid to be coated is preferably from 0.5 to 10 g/m$^2$ (based on the solid setter, an amount coated is hereinafter expressed in a value based on the solid matter, unless otherwise indicated).

Primer Layer

As shown in FIG. 2, a primer layer 4*c* may be provided, depending an the function required, between the substrate 4*a* and the coloring material-receiving layer 4*b*.

For example, in order to improve the adhesive properties, the surface of the substrate 4*a* on which the coloring material-receiving layer 4*b* will be formed may be subjected, in advance, to corona discharge treatment, ozone treatment, or anchor-coat treatment to provide a primer layer thereon.

A layer of a thermoplastic resin, a thermosetting resin, or a thermoplastic resin having a functional group which is hardened by a hardening agent or other technique can be used as the printer layer 4*c*.

Specifically, polyester resin, chlorinated polypropylene resin, modified polyolefin resin, urethane resin, acrylic resin, polycarbonate resin, an ionomer resin, a resin obtained by hardening a prepolymer containing a mono- and/or polyfunctional hydroxy group by isocyanate, or the like can be used for forming the primer layer. To these resins, a known inorganic filler such as titanium oxide, calcium carbonate or barium sulfate, an organic filler, or an additive such as a fluorescent whitening agent can be added in order to impart whiteness hiding properties or the like to the primer layer, when necessary. The thickness of the primer layer is approximately 0.5 to 30 micrometers.

Substrate

Figure 3:
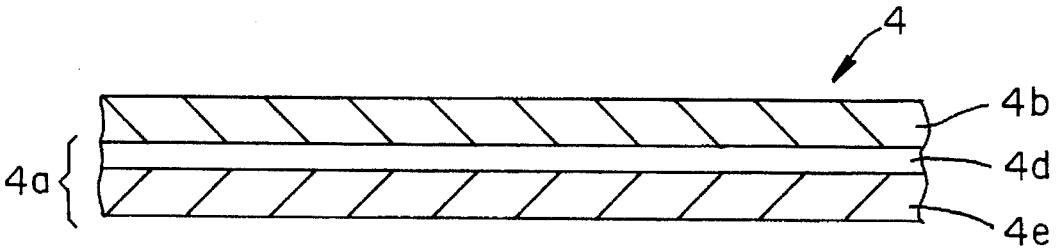
FIG. 3 is an enlarged cross-sectional view of another heat transfer image-receiving sheet.

The above-described coloring material-receiving layer 4*b* is directly provided on the substrate 4*a*, or provided on the primer layer 4*c* formed on the substrate 4*a* to obtain a heat transfer image-receiving sheet. However, in order to attain high printing sensitivity, and to obtain a high-quality image free from unevenness of density and voids, it is indispensable to provide a layer 4*d* containing microvoids as shown in FIG. 3.

The layer 4*d* containing microvoids can be provided by using as the substrate a plastic film or synthetic paper containing therein microvoids. Alternatively, the layer 4*d* containing microvoids may be formed on any or various substrates, which will be described later, by one of various coating methods.

The plastic film or synthetic paper containing microvoids can be obtained by making a film by the use of a material containing polyolefin, in particular, polypropylene as a main component, and an inorganic pigment, and stretching the film. A preferable plastic film or synthetic paper is one obtained by forming a film by the use of a compound which is prepared by blending the above material with a polymer, serving as a foaming initiator, incompatible with the inorganic pigment and/or polypropylene, and stretching the film.

In the case where the layer 4*d* is formed by using as a main component polyester or the like, the layer is poor in both cushioning properties and heat-insulating properties as compared with a polypropylene-based layer because of the viscoelasticity and thermal properties of polyester. For this reason, the resulting image-receiving sheet is poor in printing sensitivity, and an image produced thereon tends to have unevenness of density. In view of these facts, the modulus of elasticity at 20° C. of the plastic film or synthetic paper is preferably from $5\times10^8$ Pa to $1\times10^{10}$ Pa. Further, such a plastic film or synthetic paper is, in general, obtained by means of biaxial orientation. Therefore, they shrink when heat is applied thereto. The degree of shrinkage of the plastic film or synthetic paper when it in allowed to stand at 110° C. for 60 seconds is tram 0.5% to 2.5%.

The above-described plastic film or synthetic paper may consist of a single layer containing microvoids, or of a plurality of layers. In the latter case, it is possible that all of the layers contain microvoids, or that some of the layers have no microvoids. A white pigment may be incorporated, as a hiding agent, into the plastic film or synthetic paper, when necessary. Further, in order to increase the whiteness, additives such as a fluorescent whitening agent may be added. Furthermore, a skin layer may also be provided on the surface of the plastic film or synthetic paper in order to impart thereto brightness and smoothness. It is preferable that the thickness of the plastic film or synthetic paper be from 30 to 80 micrometers.

A material obtained by providing the coloring material-receiving layer on the substrate which is the above-described plastic film or synthetic paper containing microvoids can be used as it is as an image-receiving sheet.

However, such an image-receiving sheet is curled, as will be described later, during a printing process due to heat applied thereto by a thermal head. This curling can be prevented when a laminate of a support 4*e* and the above-described layer 4*d* containing microvoids is used as the substrate 4*a*.

It is preferable that the support 4*e* have a high modulus of elasticity under the standard room conditions and be excellent in thermal stability such as thermal shrinkage, as compared with the layer 4*d* containing microvoids. Specifically, coated paper, art paper, glassine paper, high-quality paper, cast-coated paper or cellulose fiber paper is preferably used as the support 4*e*.

The modulus of elasticity at 20° C. and 50 RH% of these papers is $1\times10^{10}$ Pa or more. The degree of shrinkage of these papers when they are allowed to stand at 110° C. for 60 seconds is from 0% to 0.5%.

Further, a PET film, a foamed PET film, a white PET film, an acrylic film or the like can also be used as the support 4*e*. The modulus of elasticity at 20° C. of most of these films falls in the range of $5\times10^8$ Pa to $2\times10^{10}$ Pa. The degree of shrinkage of these films when they are allowed to stand at 110° C. for 60 seconds is from 0% to 1.0%. The support is laminated on the surface of the above-described plastic layer containing microvoids, opposite to the surface on which the coloring material-receiving layer is formed. The lamination can be conducted by a known method such as the dry lamination, wet lamination, EC lamination or heat-seal lamination method.

The support 4*e* can simply be the above-described paper or PET film. However, in order to further improve the anti-curling properties, the support can be provided with a curling-preventive layer on the surface thereof, opposite to the surface on which the coloring material-receiving layer is formed. A polyolefin resin layer is preferable as the curling-preventive layer. Alternatively, the same plastic film or synthetic paper as is laminated on the coloring material-receiving layer 4*b* side may be laminated to provide the curling-preventive layer.

The most preferable thickness of the support 4*e* is approximately 50 to 120 micrometers in view of the rigidity of the image-receiving sheet and the suitability to a printer in terms of paper carriage. The preferable thickness of the curling-preventive layer is approximately 25 to 60 micrometer. The preferable thickness of the whole image-receiving sheet is approximately 100 to 250 micrometers.

The layer 4*d* containing microvoids can be obtained by farming a layer containing microvoids on the substrate by the coating method. For example, the layer containing microvoids can be formed by coating a mixture of a plastic resin and a foaming agent such as "Microsphere" onto the surface of the substrate, followed by heating. Conventionally-known resins such as polyester resin, urethane resin, polycarbonate resin, acrylic resin, polyvinyl chloride are polyvinyl acetate can be used either singly or in combination of two or more as the plastic resin.

Further, it is preferable that the modulus of elasticity at 20° C. and 50 RH% of the layer containing microvoids (Eb) be lower than that of the support (Es) (Eb <Es).

Furthermore, it is preferable that the degree of thermal shrinkage at 110° C. of the layer containing microvoids (Sb) be higher than that of the support (Ss) (Sb >Ss).

Form

The form at the image-receiving sheet 4 of the above-described basic structure is roll. In the conventional sheet-type image-receiving sheet, an image-printing area is restricted by the length of the image-receiving sheet in the longer direction thereof.

By making an image-receiving sheet into roll type, the above restriction can be substantially eliminated, that is, a panoramic image can be produced thereon.

In order to obtain a roll-type image-receiving sheet, it is necessary to wind an image-receiving sheet around a wind-up cylinder 2 which is fitted to a printer. At this time, the direction of winding is important. In general, when a film, a sheet, paper or a laminate thereof is rolled up, allowed to stand as it in for many hours, and then unrolled, the film or the like cannot be restored to flat and curl remains therein due to the viscoelasticity of the material and the curvature of the roll, as will be described later.

For this reason, it is preferable to wind the image-receiving sheet around the wind-up cylinder with the coloring material-receiving layer 4*b* outside as will be described later.

Wind-Up Cylinder

In the roll-type heat transfer image-receiving sheet 1 prepared by the above-described method, the image-receiving sheet is wound around the wind-up cylinder 2, so that high pressure acts upon the core part of the roll. Therefore, if the wind-up cylinder has a rough surface, the surface of the image-receiving sheet at the core part becomes rough. As a result, an image produced on such a rough surface of the image-receiving sheet has unevenness of density and voids.

Such a problem of roughness can be solved by controlling the maximum surface roughness of the wind-up cylinder in the longer direction of the periphery thereof to 40 micrometers or less.

There is no particular limitation on the material of the wind-up cylinder 2, and any of papers (pulp), plastics, metals, woods and composites thereof can be used. By polishing the surface of the wind-up cylinder obtained by using the above material, the surface roughness in the above-described range can be attained. However, in order to attain the above surface roughness, it is particularly preferable to use a plastic material having a smooth surface as the surface material of the wind-up cylinder. It is more preferable that the whole of the wind-up cylinder be made by using a plastic, specifically by subjecting it to injection molding or the like.

A wind-up cylinder which is obtained by covering the surface of the above-described cylinder with a cushioning material, which will be described later, can also be used as the wind-up cylinder 2 In this case, it is enough that the surface roughness of the cushioning material be 40 micrometers of less.

In order to fix the end of the image-receiving sheet 4 to the wind-up cylinder 2, a variety of adhesives, pressure-sensitive adhesives, adhesive tapes, pressure-sensitive adhesive tapes and the like can be used. Of these, a pressure-sensitive adhesive double coated tape is preferably used. In the ease where a pressure-sensitive adhesive single coated tape is used, roughness is brought about due to the end of the adhesive tape itself. However, when a pressure-sensitive adhesive double coated tape is used, the end of the tape comes between the wind-up cylinder and the image-receiving sheet, so that the image-receiving sheet is less affected by roughness caused by the tape.

Further, at the core part of the roll, there exists roughness caused due to the thickness of the image-receiving sheet itself, which is fixed to the wind-up cylinder. However, such roughness causes almost no unevenness of density nor voids in an image produced. This is because in the section of the portion where the end of the image-receiving sheet is fixed to the wind-up cylinder, the image-receiving sheet is parallel to the wind-up cylinder in the Longer direction thereof. Therefore, the section of the image-receiving sheet and the main-scanning direction of a thermal head are parallel to each other. For this reason, the roughness caused at the portion where the end of the image-receiving sheet is fixed to the wind-up cylinder and the main-scanning direction of a thermal head are parallel, so that pressure is applied, during a printing process, to the image-receiving sheet by a platen roll or the like parallel to the roughness. An image obtained is thus almost free from voids and unevenness of density.

(EXAMPLE A1)

Substrate

A biaxially-oriented polypropylene film ("Toyopearl SS P4255" manufactured by TOYOBO CO., LTD., thickness: 35 micrometers, modulus of elasticity at 20° C. 5.1×109 Pa, degree of thermal shrinkage when allowed to stand at 110° C. for 60 seconds: 0.8%) was used as the plastic film containing therein microvoids. Coated paper ("Newtop" manufactured by New Oji Paper, Co., Ltd., basis weight: 127.9 g/m$^2$, modulus of elasticity at 20° C. and 50 RH%: 2.2 ×10$^{10}$ Pa, degree of thermal shrinkage when allowed to stand at 110° C. for 60 seconds: less than 0.1) was used as the support.

The above biaxially-oriented polypropylene film was laminated on both surfaces of the support serving as a core material by the dry lamination method, thereby obtaining a substrate.

A coating liquid for fanning a coloring material-receiving layer, having the following formulation was coated onto one surface of the above substrate in an amount of 4.0 g/m$^2$ (on dry basis) by means of gravure reverse coating to form a coloring material-receiving layer, whereby an image-receiving sheet was obtained. Hereinafter, the unit "part(s)" means "part(s) by weight", unless otherwise indicated.

Coating Liquid for Forming Coloring Material-Receiving Layer

| | |
|---|---|
| Ethylene-vinyl acetate copolymer ("DENKA Vinyl #1000A" manufactured by Denki Kagaku Kogyo K.K.) | 7.2 parts |
| Vinyl chloride-styrene-acrylic copolymer ("DENKA LAC #400" manufactured by Denki Kagaku Kogyo K.K.) | 1.6 parts |
| Polyester ("Vilon 600" manufactured by TOYOBO CO., LTD.) | 11.2 parts |
| Vinyl-modified silicone oil ("X-62-1212" manufactured by SHIN-ETSU CHEMICAL CO., LTD.) | 2 parts |
| Catalyst ("PL-50T" manufactured by SHIN-ETSU CHEMICAL CO., LTD.) | 0.02 part |
| Methyl ethyl ketone | 39 parts |
| Toluene | 39 parts |

The image-receiving sheet thus obtained was slit into a sheet having a width of 110 mm. This sheet was wound around a wind-up cylinder having an inside diameter of 1 inch and a thickness of 3 mm, thereby obtaining a roll-type image-receiving sheet.

The wind-up cylinder used was one prepared by using paper with its surface polished. The maximum surface roughness of the paper was 38 micrometers. It is noted that the measurement of the maximum surface roughness was carried out by using a surface roughness tester of needle type.

(EXAMPLE A2)

A roll-type image-receiving sheet was obtained in the same manner as in Example A1 except that a wind-up cylinder having a maximum surface roughness of 7.4 micrometers, prepared by subjecting vinyl chloride resin to injection molding was used instead of the wind-up cylinder used in Example A1.

(EXAMPLE A3)

A roll-type image-receiving sheet was obtained in the same namer as in Example A1 except that a wind-up cylinder having a maximum surface roughness of 6.0 micrometers, prepared by winding a PET film ("S-10" manufactured by Toray Industries, Inc.) having a thickness of 50 micrometers around a paper-made cylinder was used instead of the wind-up cylinder used in Example A1.

Comparative Example A1

A cooperative roll-type image-receiving sheet was obtained in the same manner as in Example A1 except that a wind-up cylinder with a non-polished surface, having a maximum surface roughness of 160 micrometers was used instead of the wind-up cylinder used in Example A1.

Comparative Example A2

A comparative roll-type image-receiving sheet was obtained in the same manner as in Example A1 except that a wind-up cylinder with an embossed surface, having a maximum surface roughness of 52 micrometers was used instead of the wind-up cylinder used in Example A1.

The properties of the roll-type heat transfer image-receiving sheets obtained in the above Examples and Comparative Examples were evaluated as follows. The results are shown in Table 1.

(1) Appearance of Image-Receiving Sheet at Core Part of Roll

The appearance (roughness) of the image-receiving sheet from the point at which the end of the image-receiving sheet was fixed to the wind-up cylinder to the end of the first turn of the image receiving sheet was visually observed.

O: The surface of the image-receiving sheet was not rough.

X: The surface of the image-receiving sheet was rough.

(2) Rough Surface Region

The length of the rough surface region on the image-receiving sheet was measured from the point at which the end of the image-receiving sheet was fixed to the wind-up cylinder, and expressed in the corresponding number of turns of the image-receiving sheet.

(3) Unevenness of Color

A half-tone solid image was printed on the image-receiving sheet by an original test printer of Dai Nippon Printing Co., Ltd. (feed rate: 12 msec/line, pulse duty: 60%, voltage applied: 12.7 V). The image obtained was visually evaluated.

O: No unevenness of color was found in the image printed.

X: Unevenness of color was found in the image printed.

(4) Voids

An image was printed on the image-receiving sheet in the same manner as in the evaluation of unevenness of color. The image printed was observed as to whether voids were produced therein or not.

O: No voids were found in the image printed.

X: Voids were found in the image printed.

TABLE 1

| Example | Appearance | Rough Surface Region | Unevenness of Color | Voids |
|---|---|---|---|---|
| Example A1 | O | — | O | O |
| Example A2 | O | — | O | O |
| Example A3 | O | — | O | O |
| Comp. Ex. A1 | X | 7th turn | X | X |
| Comp. Ex. A2 | X | 4th turn | X | O |

As mentioned above, when the maximum surface roughness of a wind-up cylinder is controlled to 40 micrometers or less. The wind-up cylinder does not make the surface of an image-receiving sheet wound around the cylinder rough. Therefore, even when the image-receiving sheet at the beginning of winding was used for printing, a high-quality image free from unevenness of density and voids, having stable properties can be obtained. Thus, even such a portion of the image-receiving sheet that is near the wind-up cylinder can be used, and is not wasted.

Figure 4:
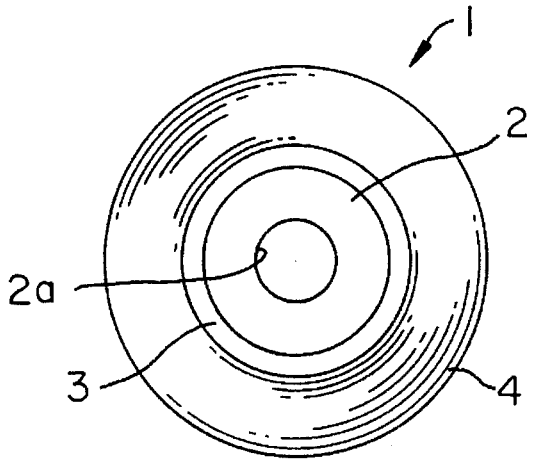
FIG. 4 is a side view of another roll-type heat; transfer image-receiving sheet according to the present invention.

Another means of obtaining an image which is free from unevenness of density and voids will be explained by referring to FIG. 4. In a roll-type heat transfer image-receiving sheet 1 shown in FIG. 4, a heat transfer image-receiving sheet 4 is wound around a pulp-made wind-up cylinder 2 which is covered with a cushioning material 3. The inner part of the wind-up cylinder 2 is hollow as indicated by reference numeral 2*a*. A foamed material made from any of various plastics can be used as the cushioning material 3. A polyethylene, polyurethane or polystyrene foamed material, or non-woven fabric is particularly preferable as the cushioning material 3. It is preferable that the thickness of this cushioning material be equal to or larger than the thickness of the heat transfer image-receiving sheet 4, or 100 micrometers or more.

The cushioning material 3 is fixed to the wind-up cylinder 2 by using a commercially available pressure-sensitive adhesive tape, pressure-sensitive adhesive double coated tape, pressure-sensitive adhesive or bonding agent. A heat-sensitive adhesive may also be used. The image-receiving sheet 4 is fixed to the cushioning material 3 in the same manner.

A lead sheet mar be used as the cushioning material 3 by joining it to the terminal end of the heat transfer image receiving sheet 4. In this case, the lead sheet is fixed to the wind-up cylinder in the same manner as the above. After the lead sheet is wound around the cylinder several times, the image receiving sheet is joined to the lead sheet and then wound up. By this method the image receiving sheet can be wound around the wind-up cylinder without being affected by the difference in level present on the surface of the cylinder. The heat transfer image receiving sheet is joined to the lead sheet without overlapping their ends by applying pressure sensitive adhesive tape on one side, preferably both sides thereof so as not to make difference in level.

Coated paper, art paper, glassine paper, high-quality paper, cast-coated paper, cellulose fiber paper, a polypropylene film, a polyethylene Zila, a PET film, a foamed PET film, a white PET film, an acrylic film or the like can be used as the lead sheet. Of these, a PET film is most preferable in view of environmental stability such as thermal stability and moisture stability. It is possible to print various pattern on the lead sheet, or to color the lead sheet in order to attain various purposes such as the detection of the core of the roll, that is, the terminal and of the image-receiving sheet.

It is preferable that the thickness of the lead sheet be equal to that of the heat transfer image-receiving sheet. Specifically, the thickness of the lead sheet is preferably 20 micrometers or more and less than 200 micrometers. When the thickness of the lead sheet is less than 20 micrometers, the lead sheet cannot fully smooth the roughness on the surface of the paper-made cylinder. On the other hand, when the thickness of the lead sheet is in excess of 200 micrometers, the roughness on the surface of the lead sheet itself adversely affects the image-receiving sheet. The thickness of the pressure-sensitive adhesive tape used for fixing the lead sheet to the cylinder is approximately 5 to 60 micrometers.

The length of the lead sheet is preferably 3 times the periphery of the cylinder or more, more preferably 5 times the periphery of the cylinder or more. When the length of the lead sheet is less than 3 times the periphery of the cylinder, the image-receiving sheet cannot be wound up without being affected by the difference in level present on the surface of the cylinder. Further, the image-receiving sheet is not wasted if the length of the lead sheet is made equal to that of an area in which an image cannot be printed by a printer.

Figure 5:
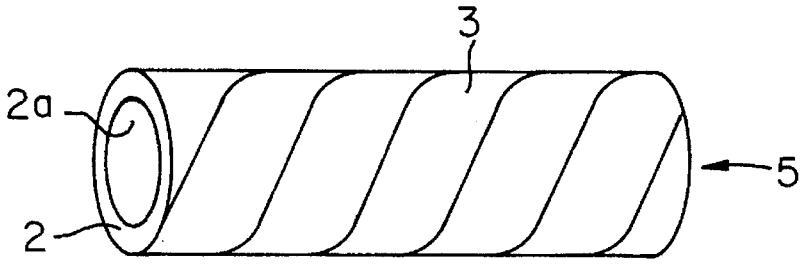
FIG. 5 is a perspective view showing a wind-tap cylinder around which a lead sheet is wound spirally.
Figure 6:
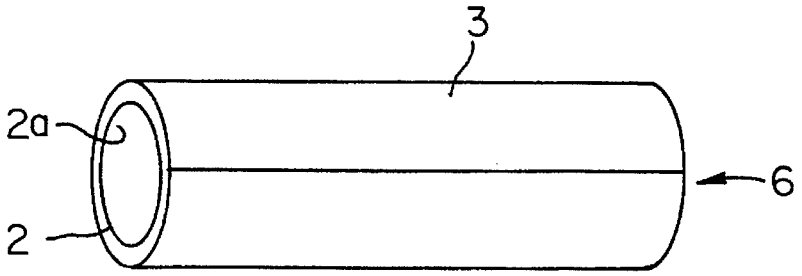
FIG. 6 is a perspective view showing a wind-up cylinder around which a lead sheet is wound flatwise.

The above-described cushioning material 3 or lead sheet may be wound around the wind-up cylinder 2 either spirally as shown in FIG. 5, or flatwise as shown in FIG. 6. Further, a protective sheet may be wound around the cushioning material 3 in order to protect the surface of the cushioning material. The same material as is used for the lead sheet can be used for the protective sheet.

The wind-up cylinder 2 for use in the present invention is a cylinder prepared by using pulp as a main component. Paper obtained from wood pulp is rolled up spirally or flatwise to obtain the wind-up cylinder. The inside of the wind-up cylinder 2 is hollow as initiated by reference numeral 2*a*, and the preferable diameter of the hollow part in approximately 5 to 200 m. The wind-up cylinder can have any outside diameter. However, an outside diameter of approximately 10 to 250 mm is preferable in order to make a printer small in size.

There is no particular limitation on the thickness of the wind-up cylinder. However, a preferable wind-up cylinder is one having a thickness of approximately 1 to 50 mm, obtained by rolling up paper having a thickness of 0.3 to 50 mm one time or several times.

(EXAMPLE B1)

Substrate

A biaxially-oriented polypropylene film ("Toyopearl SS P4255" manufactured by TOYOBO Co., LTD., having a thickness of 35 micrometers) was used an the plastic film containing therein microvoids. Coated paper ("Newtop" manufactured by New Oji Paper Co., Ltd., haling a basis weight of 127.9 g/m$^2$ was used as the support.

The above biaxially-oriented polypropylene film was laminated on both surfaces of the support serving as a core material by the dry lamination method, thereby obtaining a substrate.

A coating liquid for forming a coloring material-receiving layer, having the following formulation was coated onto one surface of the above substrate in an amount of 4.0 g/m$^2$ (on dry basis) by means of gravure reverse coating to form a coloring material-receiving layer, whereby an image-receiving sheet was obtained.

Coating Liquid for Forming Coloring Material-Receiving Layer

| | |
|---|---|
| Vinyl chloride-vinyl acetate copolymer ("DENKA Vinyl #1000A" manufactured by Denki Kagaku Kogyo K.K.) | 7.2 parts |
| Vinyl chloride-styrene-acrylic copolymer ("DENKA LAC #400" manufactured by Denki Kagaku Kogyo K.K.) | 1.6 parts |
| Polyester ("Vilon 600" manufactured by TOYOBO CO., LTD.) | 11.2 parts |
| Vinyl-modified silicone oil ("X-62-1212" manufactured by SHIN-ETSU CHEMICAL CO., LTD.) | 2 parts |
| Catalyst ("PL-50T" manufactured by SHIN-ETSU CHEMICAL CO., LTD.) | 0.02 part |
| Methyl ethyl ketone | 39 parts |
| Toluene | 39 parts |

Paper having a thickness of 7 mm was rolled up spirally to obtain a paper-made wind-up cylinder having an inside diameter of 3 inches. The end of a PET film ("S-10" manufactured by Toray Industries, Inc., having a thickness of 100 micrometers) was fixed, as the lead sheet serving as the cushioning material, to the cylinder, and wound around the cylinder in a length of 3 times the periphery of the cylinder. Thereafter, the image-receiving sheet was joined to the lead sheet without overlapping their ends, by applying a commercially available adhesive cellophane tape having a thickness of 50 micrometers on both sides thereof. The image-receiving sheet was then wound around the cylinder to obtain a roll-type heat transfer image-receiving sheet. The width of the image-receiving sheet was 220 mm, and the roll length was 100 m.

(EXAMPLE B2)

A roll-type heat transfer image-receiving sheet was obtained in the same manner as in Example B1 except that a cylinder having an inside diameter of 3 inches, prepared by rolling up paper having a thickness of 7 mm flatwise was used as the wind-up cylinder, that a polyurethane foamed material having a thickness of 200 micrometers was wound, as the cushioning material, around the wind-up cylinder one time, and that the heat transfer image-receiving sheet was directly fixed to the polyurethane foamed material by the use of an adhesive.

(EXAMPLE 3)

A roll-type heat transfer image-receiving sheet was obtained in the same manner as in Example B1 except that a polystyrene foamed material having a thickness of 300 micrometers was wound, as the cushioning material, around the wind-up cylinder one time, and that the heat transfer image-receiving sheet was directly fixed to the polystyrene foamed material by the use of an adhesive.

(EXAMPLE 4)

Coated paper ("Newtop" manufactured by New Oji Paper Co., Ltd.) having a basis weight of 72.3 g/m$^2$ was used as the substrate. A coating liquid for forming a foamed layer, having the following formulation was coated onto the surface of the substrate in an amount 10 g/m$^2$ (on dry basis) by a wire bar, and then dried in an oven, thereby forming a foamed layer.

Coating Liquid for Forming Foamed Layer

| | |
|---|---|
| Acryl-styrene emulsion ("RX2875" manufactured by Nippon Carbide Industries, Co., Inc.) | 100 parts |
| Microsphere ("551WU20" manufactured by Expancell Co., Ltd.) | 20 parts |
| Water | 20 parts |

Thereafter, the coating liquid for forming a coloring material-receiving layer prepared in Example B1 was coated onto the foamed layer in an amount of 5 g/m$^2$ (on dry basis) by a Mayerbar, and then dried by a dryer to form a coloring material-receiving layer, whereby a heat transfer image-receiving sheet was obtained.

A polyurethane foamed material serving as the cushioning material was wound around the wind-up cylinder used in Example B2. The above-obtained heat transfer image-receiving sheet was directly fined to the cushioning material, and then wound up, thereby obtaining a roll-type heat transfer image-receiving sheet.

Comparative Example B1

A comparative roll-type beet transfer image-receiving sheet was obtained in the same manner as in Example B1 except that the cushioning material used in Example B1 was not used.

Comparative Example B2

A comparative roll-type heat transfer image-receiving sheet was obtained in the same manner as in Example B2 except that the cushioning material used in Example B2 was not used.

Comparative Example B3

A comparative roll-type heat transfer image-receiving sheet was obtained in the same manner as in Example B4 except that the cushioning material used in Example B4 was not used.

Comparative Example B4

A comparative roll-type heat transfer image-receiving sheet was obtained in the same manner as in Example B1 except that the substrate used in Example B1 was replaced by coated paper having a basis weight of 72.3 g/m$^2$ ("Newtop" manufactured by New Oji Paper Co., Ltd.), and that the coating liquid for forming a coloring material-receiving layer prepared in Example B1 was coated onto the substrate in an amount of 5 g/m$^2$ (on dry basis) by a Mayerbar and dried in an oven.

The properties of the roll-type heat transfer image-receiving sheets obtained in the above Examples and Comparative Examples were evaluated as follows. The evaluation was carried out with respect to such a portion of the image-receiving sheet that is 1 m from the wind-up cylinder. The results ore shown in Table 2.

(1) Quality of Image

Half-tone solid images of yellow, magenta and cyan were printed on the image-receiving sheet by a video printer manufactured by Mitsubishi Electric Corp. The images were visually observed.

O: High-quality images tree from blurring, voids, striping and the like were obtained.

X: Blurring, voids, stripping or the like was found in the images obtained.

(2) Sensitivity

Images were obtained in the same manner as the above. The optical density of the images was measured by Machbeth Densitometer RD918. The greater the O. D. value, the higher the sensitivity.

(3) Roughness on Image-Receiving Sheet

The surface of the heat transfer image-receiving sheet was visually observed as to whether or not it had been made rough due to the roughness on the surface of the wind-up cylinder.

O: The surface of the image-receiving sheet was not rough.

X: The surface or the image-receiving sheet was rough.

(4) Unevenness of Density

Hair-tone solid images of three colors of yellow, magenta and cyan were printed on the image-receiving sheet by a video printer "CP-15" manufactured by Mitsubishi Electric Corp. The images were visually observed in terms of unevenness of density.

O: The images had no unevenness of density.

X: The images had unevenness of density.

(5) Difference in Level on Image-Receiving Sheet

Difference in Level on the heat transfer image-receiving sheet made due to the difference in level which was made when the image-receiving sheet was fixed to the wind-up cylinder was evaluated. Images were printed on the image-receiving sheet in the same manner as in the above (4).

O: No difference in level was found in both the image-printed area end the non-printed area.

X: Pattern of the difference in level appeared in the image-printed area as unevenness of density, or difference in level was made in the non-printed area.

(6) Spiral Pattern

A spiral pattern produced on the heat transfer image-receiving sheet due to the spiral pattern on the surface of the wind-up cylinder was evaluated. Printing was conducted in the same manner as in the above (4).

O: The spiral pattern on the surface of the wind-up cylinder did not appear on the image-receiving sheet.

X: The spiral pattern appeared in the image-printed area, or spiral difference in level was made in the non-printed area.

TABLE 2

| Example | Quality of Image | Sensitivity | Roughness on Image-Receiving Sheet | Unevenness of Density | Difference in Level on Image-Receiving Sheet | Spiral Pattern |
|---|---|---|---|---|---|---|
| Example B1 | O | 0.92 | O | O | O | O |
| Example B2 | O | 0.92 | O | O | O | O |
| Example B3 | O | 0.92 | O | O | O | O |
| Example B4 | O | 0.85 | O | O | O | O |
| Comp. Ex. B1 | O | 0.92 | X | X | X | X |
| Comp. Ex. B2 | O | 0.92 | X | X | X | O |
| Comp. Ex. B3 | O | 0.85 | X | X | X | X |
| Comp. Ex. B4 | X | 0.54 | O | O | O | O |

As described above, when a proper cushioning material is provided on the wind-up cylinder of a roll-type image receiving sheet, the surface of the image-receiving sheet does not become rough even if the surface of the wind-up cylinder is rough, or even if difference in level is made on the surface of the wind-up cylinder when the image-receiving sheet is fixed thereto. An image produced on such an image-receiving sheet is therefore free from unevenness of density, and any portion of the image-receiving sheet is not wasted.

When a flat material such as the previously-described substrate which is obtained by laminating a layer containing therein microvoids to a support is rolled up, allowed to stand as it is for many hours, and then unrolled, "curl" remains in the material because of the viscoelasticity of the material and the curvature of the roll.

In the case of an image-receiving sheet, the coloring material-receiving layer thereof is heated by a thermal head during a printing process, so that internal stress by which the image-receiving sheet is curled with the coloring material-receiving layer inside is accumulated in the image-receiving sheet after printing is conducted.

Therefore, in the case where curl with the coloring material-receiving layer inside is present in the image-receiving sheet before it is subjected to a printing process, the state of the curl becomes worse after printing is conducted. This fact adversely affects the carriage of the image-receiving sheet in a printer and the handling of the image-receiving sheet after printing is conducted. These problems can be solved by a heat transfer image-receiving sheet which will be explained below in detail.

As simply mentioned previously, in order to obtain a roll-type image-receiving sheet, it is necessary to wind an image-receiving sheet around a wind-up cylinder which is fitted to a printer. At this time, the direction of winding is of great importance. In general, when a film, a sheet, paper, or a laminate thereof is rolled up, allowed to stand as it is for many hours, and then unrolled, curl remains in the film or the like because of the viscoelasticity of the material and the curvature of the roll. This problem can be solved by winding an image-receiving sheet with the coloring material-receiving layer thereof outside.

The above effect is remarkable when the outside diameter of the wind-up cylinder is 100 mm or less. There is no particular limitation on the lowest limit of the outside diameter of the wind-up cylinder. However, it is practically 10 mm or more in view of the winding properties at the time of production and the practical size of a printer.

As described above, in the materials used for preparing the image-receiving sheet, the modulus of elasticity of the coloring material-receiving layer or the layer containing microvoids of the substrate is smaller than that of the support. Further, the coloring material-receiving layer is, in general, formed by using a material whose modulus of elasticity is highly dependent on temperature.

Therefore, when the image-receiving sheet is wound up with the coloring material-receiving layer inside, the amount of curl remaining in the image-receiving sheet becomes large, and, at the same time, curl is greatly developed during a printing process because shrinking force caused by heat applied during the printing process acts upon the coloring material-receiving layer side.

When the image-receiving sheet is wound up with the coloring material-receiving layer outside, the effect which is completely reverse to the above can be obtained, that is, curl does not remain in the image-receiving sheet, and curl is not developed during a printing process. Examples regarding the prevention of curling are given below.

EXAMPLE C1

Substrate

A biaxially-oriented polypropylene tutu ("Toyopearl SS P4255" manufactured by TOYOBO CO., LTD., thickness: 35 micrometers, modulus of elasticity at 20° C.: $5.1\times10^9$ Pa, degree of thermal shrinkage when allowed to stand at 110° C. for 60 seconds: 0.8%) was used as the plastic film containing therein microvoids. Coated paper ("Newtop" manufactured by New Oji Paper, Co., Ltd., basis weight: 127.9 g/m$^2$, modulus of elasticity at 20° C. and 50RH%: 2.2 $\times10^{10}$ Pa, degree of thermal shrinkage when allowed to stand at 110° C. for 60 second less than 0.1%) was used as the support.

The above biaxially-oriented polypropylene film was laminated on both surfaces of the support serving as a core material by the dry lamination method, thereby obtaining a substrate.

A coating liquid for forming a coloring material-receiving layer, having the following formulation wee coated onto one surface of the above substrate in an amount of 4.0 g/m$^2$ (on dry basis) by means of gravure reverse coating to form a coloring material-receiving layer, whereby an image-receiving sheet was obtained.

Coating Liquid for Forming Coloring Material-Receiving Layer

| | |
|---|---|
| Ethylene-vinyl acetate copolymer ("DENKA Vinyl #1000A" manufactured by Denki Kagaku Kogyo K.K.) | 7.2 parts |
| Vinyl chloride-styrene-acrylic copolymer ("DENKA LAC #400" manufactured by Denki Kagaku Kogyo K.K.) | 1.6 parts |
| Polyester ("Vilon 600" manufactured by TOYOBO CO., LTD.) | 11.2 parts |
| Vinyl-modified silicone oil ("X-62-1212" manufactured by SHIN-ETSU CHEMICAL CO., LTD.) | 2 parts |
| Catalyst ("PL-50T" manufactured by SHIN-ETSU CHEMICAL CO., LTD.) | 0.02 part |
| Methyl ethyl ketone | 39 parts |
| Toluene | 39 parts |

The image-receiving sheet thus obtained was slit into a sheet having a width of 110 mm, and 15 m of this sheet was wound around a hollow cylinder having an inside diameter of 1 inch and a thickness of 3 mm with the coloring material-receiving layer outside, thereby obtaining a roll-type image-receiving sheet.

EXAMPLE C2

A biaxially-oriented plastic film ("PL-BT" manufactured by Futamura Sansho Co., Ltd., thickness: 35 micrometers, modulus of elasticity at 20° C.: $6.2\times10^9$, degree of thermal shrinkage when allowed to stand at 110° C. for 60 seconds: 1.0%) was used as the plastic film containing therein microvoids. Coated paper ("Newtop" manufactured by New Oji Paper Co., Ltd., having a basis weight of 157 g/m$^2$) was used as the support. These two were laminated to obtain a substrate.

A roll-type image-receiving sheet was obtained in the same manner as in Example C1 except that the substrate used in Example C1 was replaced by the above-prepared substrate.

EXAMPLE C3

A roll-type image-receiving sheet was obtained in the same manner as in Example C1 except that a layer of a polyethylene resin ("Sumikasen L-5721" manufactured by Sumitomo Chemical Co., Ltd.), having a thickness of 30 micrometers was provided, instead of the biaxially-oriented polypropylene film used in Example C1, on the surface of the support opposite to the surface on which the coloring material-receiving layer was provided.

EXAMPLE C4

Paper having a thickness of 7 mm was rolled up spirally to obtain a paper-made wind-up cylinder having an inside diameter of 3 inches. The end of a PET film ("S-10" manufactured by Toray Industries, Inc., having a thickness of 100 micrometers) was fixed, as the lead sheet serving as the cushioning material, to the cylinder, and wound up in a length of 3 times the periphery of the cylinder. Thereafter, the image-receiving sheet obtained in Example C1 was joined to the lead sheet without overlapping their ends, by applying a commercially available adhesive cellophane tape having a thickness of 50 micrometers on both sides thereof. The image-receiving sheet was then wound up with the coloring material-receiving layer outside, whereby a roll-type heat transfer image-receiving sheet was obtained. The width of the image-receiving sheet was 220 mm, and the roll length was 100 m.

EXAMPLE C5

The image-receiving sheet obtained in Example C1 was slit into a sheet having a width of 110 mm, and this sheet was wound around a wind-up cylinder having an inside diameter of 1 inch and a thickness of 3 mm with the coloring material-receiving layer outside, whereby a roll-type image-receiving sheet was obtained.

The wind-up cylinder used was one prepared by using paper with its surface polished. The maximum surface roughness of the paper was 38 micrometers. The measurement of the maximum surface roughness was carried out by using a surface roughness tester of needle type.

EVALUATION

Unevenness of Density

Half-tone solid images of three colors of yellow, magenta and cyan were printed on each of the above-obtained image-receiving sheets by using a video printer "CP-15" manufactured by Mitsubishi Electric Corp. The images printed were visually observed as to whether they had unevenness of density or not. As a result, it was found that all of the images had no unevenness of density.

Comparative Example C1

A comparative roll-type image-receiving sheet was obtained In the same manner as in Example C1 except that the image-receiving sheet was wound up with the coloring material-receiving layer inside.

Comparative Example C2

A comparative roll-type image-receiving sheet was obtained in the same manner as in Example C2 except that the image-receiving sheet was wound up with the coloring material-receiving layer inside.

Comparative Example C3

A comparative roll-type image-receiving sheet was obtained by the same manner as in Example C3 except that the image-receiving sheet was wound up with the coloring material-receiving layer inside.

Comparative Example C4

A comparative roll-type image-receiving sheet was obtained in the same manner as in Example C3 except that only the coated paper "Newtop" manufactured by New Oji Paper Co. Ltd., having a basis weight of 157 g/m$^2$ was used as the substrate without providing thereon the polypropylene film containing therein microvoids. It is noted that the image-receiving sheet was wound up with the coloring material-receiving layer outside.

Comparative Example C5

A white PET film ("W-100" manufactured by Diafoil Hoechst Co., Ltd., thickness: 75 micrometers, modulus of elasticity at 20° C.: $2.1\times10^9$ Pa, degree or thermal shrinkage when allowed to stand at 110° C. for 60 seconds: 0.7%) was used as the plastic film containing therein microvoids. A plastic film ("MN247" manufactured by Mobil Plastics Europe Corp., thickness: 47 micrometers, modulus at elasticity at 20° C.: $1.3\times10_9$ Pa, degree of thermal shrinkage when allowed to stand at 110° C. for 60 seconds: 1.2%) was used as the support. The PET film and the plastic film were laminated to obtain a substrate. A comparative roll-type image-receiving sheet was prepared in the came manner as in Example C1 except that the substrate used in Example C1 was replaced by the above-obtained substrate. It is noted that the image-receiving sheet was wound lap with the coloring material-receiving layer outside.

The properties of the roll-type heat transfer image-receiving sheets obtained in the above Examples and Comparative Examples were evaluated as follows.

(1) Curl Remaining in Image-Receiving Sheet

The image-receiving sheet in the form of roll was cut into a sheet with a length of 150 mm. The sheet was placed on a horizontal plate, and the height of each of the four corners of the sheet was measured. The amount of curl was expressed as the maximum height above the horizontal plate. As mentioned previously, the image-receiving sheet tends to be curled with the coloring material-receiving layer inside. Also, in the case where curl is present in the image-receiving sheet before it is subjected to a printing process, the amount of curl tends to become larger after printing is conducted. Curl in the image-receiving sheet was evaluated in accordance with the following standard.

O: Curl with the coloring material-receiving layer outside.

X: Curl with the coloring material-receiving layer inside (amount of curl 10 mm or more).

(2) Curl Developed During Printing Process

After solid images of three colors of yellow, magenta and cyan were printed on a printing area of 95 mm×135 mm, the image-receiving sheet was evaluated in terms of curl developed during the printing process. The amount of curl was measured in the same manner as in the above (1).

O: The amount of curl is 10 mm or less irrespective of the direction of the curl.

Δ: The amount of curl is 20 mm or less irrespective of the direction of the curl X: The amount of curl is more than 20 mm irrespective of the direction of the curl.

When the amount of curl falls in the above range "X", there may be a case where jamming is caused while the image-receiving sheet is being carried in a printer. When the amount of curl falls in the range " ", although no trouble is caused while the image-receiving sheet is being carried in a printer, it is hard to cut away the image-printed portion from the roll of the image-receiving sheet after printing is completed.

(3) Quality of Image

An image with gradation was printed on the image-receiving sheet by using a printer "UP-5100" manufactured by SONY Corporation. The image was evaluated in terms of unevenness of density.

O: No unevenness of density was found in the image printed.

X: Unevenness of density was found in the image printed.

(4) Modulus of Elasticity

The modulus of elasticity in tension was measured at a frequency of 1 Hz by using a viscoelasticity spectrometer "DMS 210" manufactured by Seiko Electronics Industries Co., Ltd. The modulus of elasticity of the layer containing microvoids (Eb), and that of the support (Es) were compared as to which one was higher.

(5) Degree of Shrinkage

The image-receiving sheet was allowed to stand at 110° C. for 60 seconds, and the degree of shrinkage was measured. The degree of shrinkage of the layer containing microvoids (Sb), and that of the support (Ss) were compared as to which one was higher.

The results of the above (1) to (5) are shown in Table 3.

TABLE 3

| Example | Curl Remaining in Image-Receiving Sheet | Curl Developed during Printing Process | Quality of Image | Modulus of Elasticity | Degree of Shrinkage |
|---|---|---|---|---|---|
| Example C1 | O | O | O | Eb < Es | Sb > Ss |
| Example C2 | O | Δ | O | Eb < Es | Sb > Ss |
| Example C3 | O | O | O | Eb < Es | Sb > Ss |
| Example C4 | O | O | O | Eb < Es | Sb > Ss |
| Example C5 | O | O | O | Eb < Es | Sb > Ss |
| Comp. Ex. C1 | X | O | O | Eb < Es | Sb > Ss |
| Comp. Ex. C2 | X | X | O | Eb < Es | Sb > Ss |
| Comp. Ex. C3 | X | Δ | O | Eb < Es | Sb > Ss |
| Comp. Ex. C4 | O | X | X | — | — |
| Comp. Ex. C5 | O | X | X | Eb > Es | Sb < Ss |

As mentioned above, when an image-receiving sheet which has high printing sensitivity and on which an image free from unevenness of density can be produced is made into the form of roll, the restriction of an image-printing area to the longer direction of the image-receiving sheet can be eliminated. Further, by winding up the image-receiving sheet with the coloring material-receiving layer outside, curl remaining in the image-receiving sheet, and curl developed during a printing process can be reduced. When no curl is present in the image-receiving sheet, or when no curl is developed during a printing process, no trouble is caused when the image-receiving sheet is carried in a printer. It is noted that this means of preventing curling can be used singly irrespective of the other characteristic features of the present invention.

Regarding a printer for use with the above-described roll-type heat transfer image-receiving sheet, it is necessary to lead the image-receiving sheet between a platen roll and a plurality of carrier rolls when it is set in the printer. However, in general, the printer is precisely designed, so that there is almost no extra space inside the printer. Therefore, it has been troublesome for an operator to lead the image-receiving sheet through the printer.

Further, during the operation of leading the image-receiving sheet through the printer, the leading end of the image-receiving sheet tends to be folded or rumpled. Such a portion of the image-receiving sheet cannot be used, and thus a large amount of the image-receiving sheet has been wasted. In order to solve this problem, it is desirable to partly cut the leading end of a heat transfer image-receiving sheet so that the width of the foremost part will be 0% to 90% of that of the image-receiving sheet. Specific embodiments of this will now be explained in detail.

Figure 7:
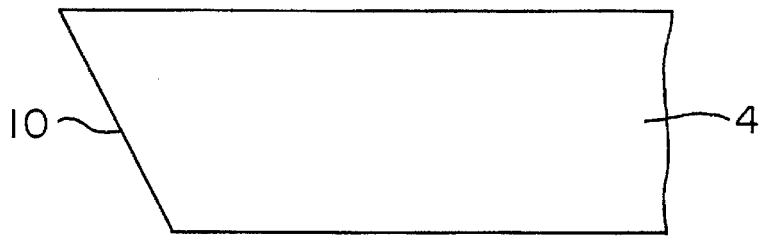
FIGS. 7 to 10 are illustrations each showing the shape of the leading end of a heat transfer image-receiving sheet.
Figure 8:
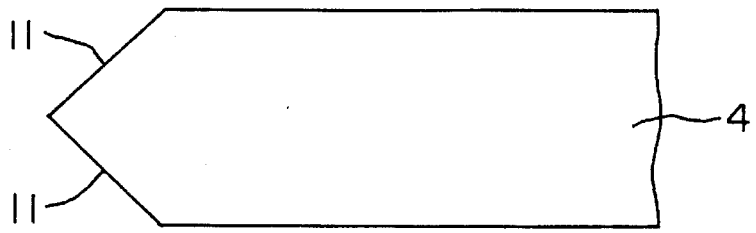

In an embodiment shown in FIG. 7, the leading end of the heat transfer image-receiving sheet 4 is obliquely cut as indicated by reference numeral 10. In an embodiment shown in FIG. 8, the leading end of the image-receiving sheet 4 is out in such a manner that two oblique sides 11 intersect at the center of the leading end. In an embodiment shown in FIG. 9, the shape of the leading end of the image-receiving sheet 4 is made into a rectangle 12 having a narrow width. In an embodiment shown in FIG. 10, the shape of the leading end of the image-receiving sheet 4 is made into a trapezoid.

Figure 9:
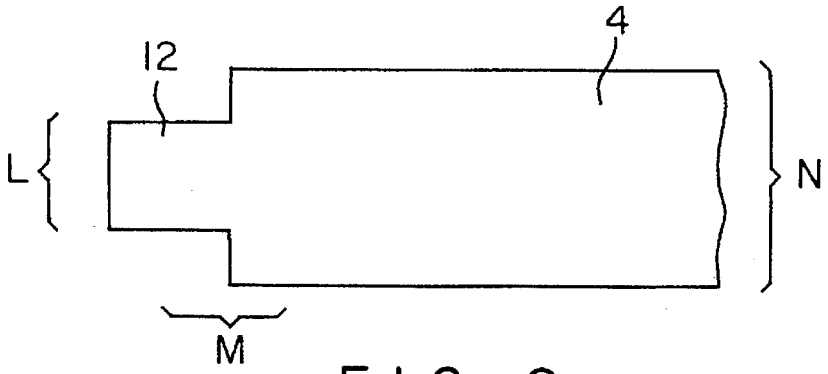
Figure 10:
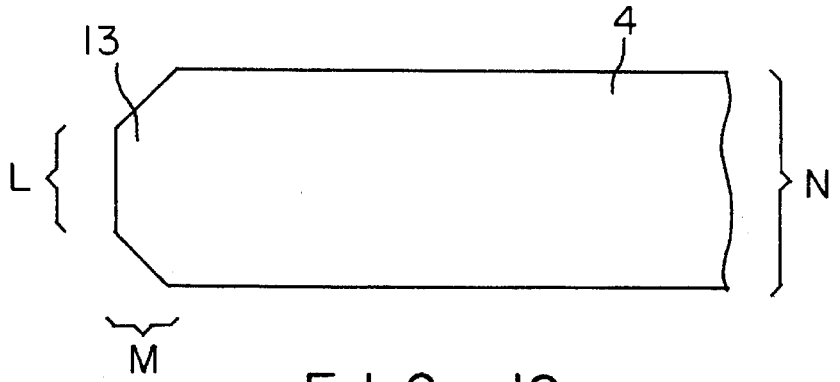

In FIG. 9, "L" indicates the width of the foremost part of the leading end of the image-receiving sheet, "M" indicates the length of the leading end in the longer direction thereof, and "N" indicates the width of the image-receiving sheet 4. In this embodiment, as shown in the figure, the leading end of the heat transfer image-receiving sheet is partly cut so that the width "L" of the foremost part of the leading end will be 0% to 90% of the width "N" of the heat transfer image-receiving sheet. In the embodiments shown in FIGS. 7 and 8, the width of the foremost part of the leading end is 0% of that of the image-receiving sheet. In the embodiments shown in FIGS. 9 and 10, the width of the foremost part of the leading end is 50% of that of the image-receiving sheet By making the leading end at the image-receiving sheet like this, the possibility that the image-receiving sheet touches various obstacles in a printer, such as rolls and walls, when it is led through narrow space in the printer. Thus, it becomes extremely easy to set the image-receiving sheet in the printer.

When the width "L" of the foremost part of the leading end is in excess of 90% of the width "N" of the heat transfer image-receiving sheet, the effect of narrow width cannot be sufficiently obtained. Further, it is preferable that the length "M" of the leading end in the longer direction thereof be 5% to 300% of the width "N" of the heat transfer image-receiving sheet. When "M" is less than 5% of "N", almost no effect of narrow width can be obtained. On the other hand, when "M" is in excess of 300% of "N", an increased amount of the image-receiving sheet is wasted, so that such a length is unfavorable.

It is most preferable that the leading end of the image-receiving sheet be obliquely cut as shown in FIG. 7.

In order to further improve the anti-curling properties in printing, a curling-preventive layer can be provided on the surface of the support opposite to the surface on which the coloring material-receiving layer is formed. A polyolefin resin layer in preferable as the curling-preventive layer. Further, the same plastic film or synthetic paper as is laminated on the coloring material-receiving layer side may be laminated to provide the curling-preventive layer.

The most preferable thickness of the support is approximately 50 to 120 micrometers in view of the rigidity of the image-receiving sheet and the suitability to a printer in terms of paper carriage. The preferable thickness of the curling-preventive layer is approximately 25 to 60 micrometers. The preferable thickness of the whole image-receiving sheet is approximately 100 to 250 micrometers.

In the roll-type image-receiving sheet, the direction of the winding of the image-receiving sheet is of great importance. In general, when a film, a sheet, paper or a laminate thereof is rolled up, allowed to stand as it is for many hours, and then unrolled, curl remains in the film or the like because of the viscoelasticity of the material and the curvature of the roll.

Further, the materials used for preparing the image-receiving sheet have modulus of elasticity which is highly dependent on temperature. As described above, the coloring material-receiving layer has the lowest modulus of elasticity, and, in the substrate, a layer which is positioned near the coloring material-receiving layer has a lower modulus of elasticity. Therefore, when the image-receiving sheet in wound up with the coloring material-receiving layer inside, the sheet is curled more easily.

Furthermore, the image-receiving sheet in curled by heat which is applied during a printing process. This curling is caused because of the shrinkage of the surface of the image-receiving sheet which is brought into contact with a thermal head. For this reason, when the image-receiving sheet is wound up with the coloring material-receiving layer inside, curl is greatly developed during a printing process.

When the image-receiving sheet is wound up with the coloring material-receiving layer outside, the amount of curl remaining in the image-receiving sheet, and that of curl developed during a printing process can be made small. Therefore, it is preferable to wind up the image-receiving sheet with the coloring material-receiving layer outside. Examples will be given below.

EXAMPLE D1

Substrate

A biaxially-oriented polypropylene film ("Toyopearl SS P4255 manufactured by TOYOBO CO., LTD., having a thickness of 35 micrometers) was used as the plastic film containing therein microvoids. Coated paper ("Newtop" manufactured by New Oji Paper, Co., Ltd., having a basis weight of 127.9 g/m$^2$) was used as the support.

The above biaxially-oriented polypropylene film was laminated on both surfaces of the support serving as a core material by the dry lamination method, thereby obtaining a substrate.

A coating liquid for forming a coloring material-receiving layer, having the following formulation was coated onto one surface of the above substrate in an amount of 4.0 g/m$^2$ (on dry basis) by means of gravure reverse coating to form a coloring material-receiving layer, whereby in image-receiving sheet was obtained.

Coating Liquid for Forming Coloring Material-Receiving Layer

| | |
|---|---|
| Ethylene-vinyl acetate copolymer ("DENKA Vinyl #1000A" manufactured by Denki Kagaku Kogyo K.K.) | 7.2 parts |
| Vinyl chloride-styrene-acrylic copolymer ("DENKA LAC #400" manufactured by Denki Kagaku Kogyo K.K.) | 1.6 parts |
| Polyester ("Vilon 600" manufactured by TOYOBO CO., LTD.) | 11.2 parts |
| Vinyl-modified silicone ("X-62-1212" manufactured by SHIN-ETSU CHEMICAL CO., LTD.) | 2 parts |
| Catalyst ("PL-50T" manufactured by SHIN-ETSU CHEMICAL CO., LTD.) | 0.02 part |
| Methyl ethyl ketone | 39 parts |
| Toluene | 39 parts |

The image-receiving sheet thus obtained was slit into a sheet having a width of 110 mm. 15 m of this sheet was wound, with the coloring material-receiving layer outside, around a hollow cylinder having an inside diameter of 1 inch and a thickness of 3 mm, thereby obtaining a roll-type image-receiving sheet. The leading end of the image-receiving sheet was made into the shape shown in FIG. 8. The length of the leading end in the longer direction thereof was 110 mm.

EXAMPLE D2

A roll-type heat transfer image-receiving sheet was prepared in the same manner as in Example D1 except that the leading end of the image-receiving sheet was made into the shape shown in FIG. 9. It is noted that the width of the foremost part of the leading end was 50 mm, and the length of the leading end in the longer direction thereof was 100 mm.

EXAMPLE D3

Paper having a thickness of 7 mm was rolled up spirally to obtain a paper-made wind-up cylinder having an inside diameter of 3 inches. The end of a PET film ("S-10" manufactured by Toray Industries, Inc., having a thickness of 100 micrometers) was fixed, as the lead sheet serving as the cushioning material, to the cylinder, and wound up in a length of 3 times the periphery of the cylinder. Thereafter, the image-receiving sheet obtained in Example D1 was joined to the lead sheet without overlapping their ends, by applying a commercially available adhesive cellophane tape having a thickness of 50 micrometers on both sides thereof. The image-receiving sheet was then wound up to obtain a roll-type heat transfer image-receiving. The width of the image-receiving sheet was 220 mm, and the roll length was 100 m. The leading end of the image-receiving sheet was made into the shape shown in FIG. 9. The length of the leading end in the longer direction thereof was 110 mm.

EXAMPLE D4

The image-receiving sheet obtained in Example D1 was slit into a sheet having a width of 110 mm, and this sheet was wound around a wind-up cylinder having an inside diameter of 1 inch and a thickness of 3 mm, whereby a roll-type image-receiving sheet was obtained.

The wind-up cylinder used was one prepared by using paper with its surface polished. The maximum surface roughness of the paper was 38 micrometers. The measurement of the maximum surface roughness wee carried out by using a surface roughness tester of needle type.

The leading end of the image-receiving sheet was made into the shape shown in FIG. 9. The length of the leading end in the longer direction thereof was 110 mm.

Comparative Example D1

A comparative roll-type heat transfer image-receiving sheet was prepared in the same manner as in Example D1 except that the leading end of the image-receiving sheet was not cut into any shape.

The properties of the roll-type heat transfer image-receiving sheets obtained in the above Examples and Comparative Example were evaluated as follows. The results are shown in Table 4.

(1) Easiness of Setting

Easiness of setting of the image-receiving sheet in an original printer for evaluation of Dai Nippon Printing Co., Ltd., was examined.

O: It is easy to set the image-receiving sheet in the printer.

X: It is difficult to set the image-receiving sheet in the printer.

(2) Rumpling, Folding

The image-receiving sheet was observed as to whether it was rumpled or folded when set in the printer.

O: The image-receiving sheet was neither rumpled nor folded.

Δ: Only the leading end of the image-receiving sheet was rumpled or folded.

X: The image-receiving sheet was rumpled or folded.

(3) Loss of Image-Receiving Sheet (unit: mm)

O: Only the leading end of the image-receiving sheet was wasted.

X: Not only the leading end but also the image-receiving sheet was wasted.

(4) Unevenness of Density

Half-tone solid images of three colors of yellow, magenta and cyan were printed on the image-receiving sheet by using a video printer "CP-15" manufactured by Mitsubishi Electric Corp. The images printed were examined as to whether they had unevenness of density or not.

TABLE 4

| Example | Easiness of Setting | Rumpling, Folding | Loss of Image-Receiving Sheet | Unevenness of Density |
|---|---|---|---|---|
| Example D1 | O | O | O | none |
| Example D2 | O | Δ | O | none |
| Example D3 | O | O | O | none |
| Example D4 | O | O | O | none |
| Comp. Ex. D1 | X | X | X | produced |

As mentioned above, when the width of the leading end of a roll-type heat transfer image-receiving sheet is made narrow, the image-receiving sheet can be easily set in a printer. Further, such an image-receiving sheet is not rumpled nor folded when it is set in a printer, so that a loss of the image-receiving sheet can be reduced. It is possible to make the leading end of the image-receiving sheet into any of the above-described shapes irrespective of the other characteristic features of the present invention.

When an image-receiving sheet is made into the form of roll, it is necessary to provide some means for knowing the residual quantity of the image-receiving sheet. Possible means of this are, for example, to print a detector mark to apply a detectable tape, and to make a hole in the vicinity of the terminal end of the image-receiving sheet. However, such means have a shortcoming in that the production of the image-receiving sheet becomes complicated, resulting in an increase in the production cost. Another problem is that an image cannot be printed on the mark-printed area of the image-receiving sheet, so that such an area is wasted.

In order to solve these problems, the reflecting properties of at least a part of the surface of the previously-mentioned wind-up cylinder are made different from those of at least one surface of the above-described heat transfer image-receiving sheet. The terminal end of the image-receiving sheet can thus be known by using an optically-detecting sensor or the like, utilizing the difference between the reflectivity of at least a part of the surface of the wind-up cylinder, and that of at least one surface of the image-receiving sheet.

Preferable embodiments of the above will be explained below in detail.

It is noted that all of the reflectivities shown in this Specification are values obtained by a measurement carried out by using UV-VIS-NIR-RECORDING SPECTROPHOTOMETER manufactured by Shimadzu Corp.

Wind-Up Cylinder

In a printer for use with a conventional sheet-type image-receiving sheet, a transmission-type or reflection-type optical sensor, which can detect a detector mark or the like provided on the surface or the back surface of the image-receiving sheet, has been used to judge whether the image-receiving sheet is present or not, and whether the image-receiving sheet is correctly set or not. Such a method of detection cars also be utilized in a printing process in which a roll-type heat transfer image-receiving sheet prepared by fixing the terminal end of a continuous image-receiving sheet to a wind-up cylinder, and winding the image-receiving sheet around the wind-up cylinder is used. In this case, it is necessary to control the reflectivity of the surface of the wind-up cylinder, which in prepared by using the following material and made into in the following shape, different from that of the surface of the image-receiving sheet. Specific methods for attaining this will be explained below.

Any of papers, plastics, metals, woods and composites thereof can be used as a material for the wind-up cylinder. However, paper, a plastic or a composite thereof is preferable when processability, cost and handling are taken into consideration. There is no particular limitation on the shape of the wind-up cylinder; the wind-up cylinder can take any shape as long as it is fitted to a printer.

The coloring material-receiving layer of an image-receiving sheet except an image-receiving sheet for transparent manuscript paper is, in general, white or light-colored so that a high-quality image can be produced thereon. Further, the surface of the image-receiving sheet opposite to the surface on which the coloring material-receiving layer is formed is also, in general, white or light-colored. Therefore, the reflectivity of the surface of a wind-up cylinder can be made different from that of the surface of an image-receiving sheet by coloring the wind-up cylinder with a color deeper than the color of the image-receiving sheet. Detection by a sensor or the like can thus be made possible.

There can be considered various methods for coloring a wind-up cylinder. One example is such that a material for preparing a wind-up cylinder is colored so as to color the entire surface of the wind-up cylinder. For instance, a coloring agent such as a pigment or a dye is mixed with pulp, and the mixture is subjected to paper making; a coating liquid containing a pigment or a dye is coated onto paper having a high reflectivity for coloring, and the colored paper is rolled up to obtain a colored-paper cylinder; or a pigment or a dye is mixed with a resin which is a material for a wind-up cylinder, and the mixture is subjected to molding to obtain a resin pipe.

Further, in the case where a wind-up cylinder is entirely or partially colored, the surface of a wind-up cylinder can be covered with colored paper such as natural or synthetic paper, or a colored sheet or film made from a resin or the like. Alternatively, the surface of a wind-up cylinder can be colored by various coloring materials such as a paint. For example, in order to cover the surface of a wind-up cylinder, paper obtained from a mixture of pulp and a coloring agent such as a pigment or a dye, colored paper obtained by coating a coating liquid which contains a pigment or a dye onto paper having a high reflectivity, a film obtained from a mixture of a resin and a pigment or a dye, or a film coated with a coating liquid which contains a pigment or a dye can be used.

It is noted that the covering of a wind-up cylinder can be conducted by means of an adhesive, a pressure-sensitive adhesive, a pressure-sensitive adhesive double coated tape or the like. It is also possible to adhere, to a wind-up cylinder, a seal which has been colored to such a degree that it can be detected.

In the present invention, when a wind-up cylinder is partially colored, no particular limitation is imposed on the portion to be colored and the pattern of coloring. It is however necessary that a portion which should be detected by an optical sensor be colored so that it can be successfully detected. In order to recognize by human eyes or an ordinary optical sensor which in equipped to a printer, it in preferable that at least 0.1% or more of the surface area of a wind-up cylinder be colored. When the colored area is less than 0.1% of the entire surface, there may be a case where the colored area cannot be recognized by a user of the printer or the sensor equipped to the printer.

The reflectivity of a commercially available image-receiving sheet to light having a wavelength of 400 nm to 1200 nm is 70% or more. Therefore, when a continuous image-receiving sheet having the reflecting properties comparable to the above is used, it is enough that the reflectivity of the surface or the wind-up cylinder to light in the above wavelength region is lower than 70%. However, an optical sensor usually used detects only light of a specific wavelength region. Therefore, detection is possible if the reflectivity of a wind-up cylinder and that of an image-receiving sheet are different only to light of such a wavelength region. Further, in general, infrared light as utilized for most of the sensors used for this purpose. Therefore, it is preferable to use a wind-up cylinder having a surface whose reflectivity to light having a wavelength at 600 nm to 1200 nm is lower than 70% because an ordinary sensor can be used. Furthermore, it is more preferable to entirely or partially make a wind-up cylinder black. This is because a wind-up cylinder entirely or partially blacked has an extremely low reflectivity to light having any wavelength, so that a sensor of any type, and even a sensor having a low sensitivity can be used for detection.

In the case of the roll-type image-receiving sheet of the present invention, even when the difference between the reflectivity of the image-receiving sheet and that of the surface of the wind-up cylinder is small, detection is possible by a sensor if the sensitivity thereof is high. However, it is preferable that the difference between the two reflectivities be 10% or more.

As mentioned previously, a lead sheet can be provided to the terminal end of the roll-type image-receiving sheet of the present invention. In this case, the detection of the terminal end of the image-receiving sheet is made possible by making, in the above-described manner, the reflecting properties of at least one surface of the image-receiving sheet including the lead sheet different from those of at least a part of the surface of the wind-up cylinder.

As mentioned previously, when a cushioning material is provided on the surface of a wind-up cylinder, roughness on the surface of the wind-up cylinder is absorbed by the cushioning material due to the cushioning properties thereof, so that an image printed on the image-receiving sheet is not adversely affected by the roughness. However, in the case where a cushioning material is used to cover the outermost surface of a wind-up cylinder, it is necessary to color the cushioning material by any one of the previously-mentioned methods of coloring.

When a lead sheet is used, it is fixed to a wind-up cylinder in the same manner as in the case where the terminal end of an image-receiving sheet is fixed to a wind-up cylinder, and wound around the cylinder several times. Thereafter, a heat transfer image-receiving sheet is joined to the lead sheet. By this method, the image-receiving sheet can be wound around the wind-up cylinder without being affected by the difference in level present on the surface of the wind-up cylinder. The heat transfer image-receiving sheet is joined to the lead sheet without overlapping their ends so as not to make difference in level, by applying a pressure-sensitive adhesive tape on one side, preferably both sides thereof.

Coated paper, art paper, glassine paper, high-quality paper, cast coated paper, cellulose fiber paper, a polypropylene film, a polyethylene film, a PET film, a foamed PET film, a white PET film, an acrylic film or the like can be used as the lead sheet. Of these, a PET film is preferable in view of environmental stability such as thermal stability and moisture stability.

EXAMPLE E1

A foamed polypropylene film containing microvoids ("35 Mw846" manufactured by Mobil Plastics Europe Corp., having a thickness of 35 micrometers) whose both surfaces were treated so as to impart thereto adhesive properties was used as the substrate. A coating liquid for forming a coloring material-receiving layer, having the following formulation was coated onto the surface of the substrate in an amount of 3.0 g/m$^2$ (on dry basis) by a wire bar, and then dried to form a coloring material-receiving layer. This was laminated on coated paper having a basis weight of 127.9 g/m$^2$ ("Pearl-Kote" manufactured by Mitsubishi Paper Mills, Ltd.) serving as the support by means of dry lamination, using an adhesive, whereby an image-receiving sheet was obtained. It is noted that the reflectivity of this image-receiving sheet to light having a wavelength of 850 nm was 85%.

Coating Liquid for Forming Coloring Material-Receiving Layer

| | |
|---|---|
| Polyester resin ("Vilon 200" manufactured by TOYOBO CO., LTD.) | 20 parts |
| Silicone oil ("X22-3050C" manufactured by SHIN-ETSU CHEMICAL CO., LTD.) | 1 part |
| Silicone oil ("X22-3000E" manufactured by SHIN-ETSU CHEMICAL CO., LTD.) | 1 part |
| Toluene | 50 parts |
| Methyl ethyl ketone | 50 parts |

A wind-up cylinder was prepared by adhering craft paper whose reflectivity to light having a wavelength of 850 nm was 65% to the entire surface of a paper pipe (inside diameter: 1.5 inches, thickness: 4 mm, length: 300 mm), which was obtained by rolling up cellulose paper spirally, by using a pressure-sensitive adhesive. Subsequently, the terminal end of the above-obtained image-receiving sheet was fined to the wind-up cylinder by using a pressure-sensitive adhesive double coated tape. The image-receiving sheet was then wound around the wind-up cylinder almost one time, thereby obtaining a roll-type heat transfer image-receiving sheet of the present invention.

EXAMPLE E2

A coating liquid for forming a foamed layer, having the following formulation was coated onto the surface of coated paper having a basis weight of 84.7 g/m$^2$ in an amount of 10 g/m$^2$ (on dry basis), and then dried, thereby obtaining a substrate. On this substrate, a coloring material-receiving layer was provided in the same manner as in Example E1, whereby an image-receiving sheet was obtained. It is noted that the reflectivity to light having a wavelength of 850 nm of this image-receiving sheet was 75%.

Coating Liquid for Forming Foamed Layer

| | |
|---|---|
| Ethylene-vinyl acetate copolymer emulsion ("XB3647B" manufactured by Tohpe Corporation) | 100 parts |
| Microsphere ("F30VS" manufactured by Matsumoto Yushi-Seiyaku K.K.) | 10 parts |
| Water | 10 parts |

Thereafter, a black pressure-sensitive adhesive tape whose reflectivity to light having a wavelength of 850 nm was 15% was cut square (10 cm×10 cm), and adhered to a vinyl chloride-made pipe (inside diameter: 3 inches, thickness: 3 mm, length: 250 mm) at the center of the width direction thereof, thereby obtaining a wind-up cylinder.

Subsequently, the terminal end of the image-receiving sheet was fixed, by a commercially available pressure-sensitive adhesive tape, to the portion on the wind-up cylinder where the black tape was not adhered, and the image-receiving sheet was then wound around the wind-up cylinder almost one time, whereby a roll-type image-receiving sheet was obtained.

EXAMPLE E3

A foamed polyethylene sheet having a thickness of 1.5 mm, serving as the cushioning material, was adhered, by the use of a pressure-sensitive adhesive, to the entire surface of a paper pipe (inside diameter: 1.5 inches thickness: 4 mm, length: 30 mm) which was prepared by rolling up cellulose paper spirally. Black paper whose reflectivity to light having a wavelength of 850 nm was 50% was adhered to the entire surface of the cushioning material by using a pressure-sensitive adhesive. Thus, a wind-up cylinder was obtained. The terminal end of the image-receiving sheet obtained in Example E1 was fired to this wind-up cylinder by using a commercially available pressure-sensitive adhesive tape, and the image-receiving sheet was wound around the wind-up cylinder almost one time, whereby a roll-type image-receiving sheet of the present invention was obtained.

EXAMPLE E4

The image-receiving sheet prepared in Example E1 was slit into a sheet having a width of 110 mm. This sheet was wound around a wind-up cylinder having an inside diameter of 1 inch and a thickness of 3 mm, thereby obtaining a roll-type image-receiving sheet.

The wind-up cylinder used was one prepared by using paper with its surface polished. The maximum surface roughness of the paper was 38 micrometers. It is noted that the maximum surface roughness was measured by a surface roughness tester of needle type.

The reflectivity of the wind-tip cylinder to light having a wavelength of 850 nm was 65%.

Comparative Example E1

A comparative roll-type image-receiving sheet was obtained in the same manner as in Example E2 except that the wind-up cylinder used in Example E2 was replaced by a wind-up cylinder whose reflectivity to light having a wavelength of 850 nm was 80%.

Evaluation

The roll-type image-receiving sheets obtained in the above Examples and Comparative Example were tested by using a test printer which contains as a light source a light emitting diode (peak wavelength: 940 nm) and as a terminal end detector a reflection-type photomicrosensor having as a light-receiving part a photo transistor whose spectrally-sensitive wavelength was 850 nm. The terminal end of each of the roll-type image-receiving sheets obtained in Examples E1 to E4 was detected, but that of the image-receiving sheet obtained in Comparative Example E1 was not detectable.

Further, the image-receiving sheets obtained in Examples E3 and E4 were evaluated in terms of unevenness of density as follows. Half-tone solid images of three colors of yellow, magenta and cyan were printed on each of these image-receiving sheets by a video printer "CF-15" manufactured by Mitsubishi Electric Corp. The images printed were visually observed. As a result, unevenness of density was not found in either cases.

As mentioned above, when a wind-up cylinder whose reflectivity is different form that of at least one surface of an image-receiving sheet is used as the core of a roll-type image-receiving sheet, the terminal end of the image-receiving sheet can be detected by utilizing the difference between the two reflectivities. Further, since a detector mark is not provided on the image-receiving sheet itself, the production of the image-receiving sheet is not complicated, and the production cost is not increased.

When a roll-type heat transfer image-receiving sheet is set in a printer, it is necessary to lead the image-receiving sheet through a paper-carrying system composed of a platen roll, a plurality of carrying rolls, a guide roll and the like. In general, the inside of a printer is precisely designed, so that there is almost no extra space inside the printer. Therefore, it is quite troublesome for an operator to lead the image-receiving sheet through the printer. Further, during this operation, the leading end of the image-receiving sheet tends to be folded or rumpled, or the fingers of the operator often unintentionally touch the surface of the image-receiving sheet. For this reason, there may be a case where the image-receiving sheet in a length corresponding to the length of the paper-carrying system cannot be used and is wasted.

In order to solve the above problem, a lead sheet can be provided to the leading end of an image-receiving sheet.

The foremost part of the lead sheet is cut so that the width thereof will be from 0% to 90% of that of the image-receiving sheet. The length of the foremost cut portion of the lead sheet in the longer direction thereof is 0.5 times the width of the image-receiving sheet or more, and 10 times the width of the image-receiving sheet or less.

The length of the lead sheet except the above-described cut portion is one time the outermost periphery of the roll of image-receiving sheet or more, and 10 times the outermost periphery of the roll or less. A transparent material is preferably used for the lead sheet. The thickness of the lead sheet is 20 micrometers or more, and 200 micrometers or less.

Further, it is possible to indicate information concerning the image-receiving sheet and a printer to be used therewith on the surface of the lead sheet, if necessary.

The lead sheet can be made into any of the shapes shown in FIGS. 11 to 16. In an embodiment shown in FIG. 11, the width "W" of the lead sheet 20A is from 0% to 90% of that of the image-receiving sheet, and the foremost part of the lead sheet in cut obliquely as indicated by reference numeral 21. The length "L" of the cut portion in the longer direction thereof is 0.5 times the width of the image-receiving sheet or more, and 10 times the width of the image-receiving sheet or less.

Figure 12:
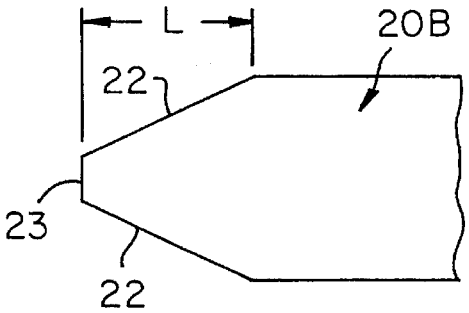

In a lead sheet 20B shown in FIG. 12, the foremost part of the lead sheet is tapered by two oblique sides 22, and the end 23 of the tapered portion is straight and narrow.

Figure 13:
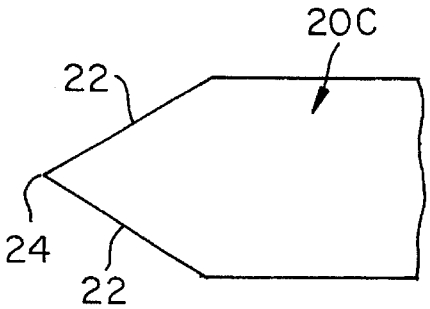

In a lead sheet 20C shown in FIG. 13, two oblique sides 22 intersect at the point 24. In a lead sheet 20D shown in FIG. 14, two oblique sides 22 intersect at the curved point 25.

Figure 15:
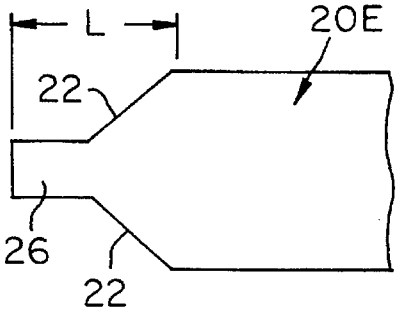

In a lead sheet 20E shown in FIG. 15, the foremost part of the lead sheet is tapered by two oblique aides 22, and the end of the tapered portion is made into a tape-like rectangle.

Figure 16:
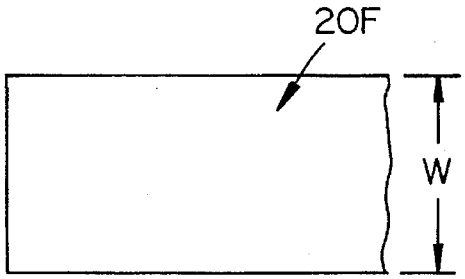

A lead sheet 20F shown in FIG. 16 in simply in the shape of tape, but the width of the lead sheet is smaller than that of the image-receiving sheet.

By providing any of the above-described lead sheets to the leading end of an image-receiving sheet, the restriction of an image-printing area to the flow direction of the image-receiving sheet can be eliminated, and an image-receiving sheet which can be easily set in a printer and which is not wasted by being damaged or stained when set in a printer can be obtained.

Examples concerning the lead sheet are given below.

Examples F1–F11 & Comparative F1

Coated paper ("Newtop" manufactured by New Oji Paper, Co., Ltd.) having a basis weight of 127.9 g/m$^2$ was used as the support. A biaxially-oriented polypropylene film ("Toyopearl SS p4255" manufactured by TOYOBO CO., LTD.) having a thickness of 35 micrometers was used as the plastic layer containing therein microvoids. This film was laminated on both surfaces of the support by the dry lamination method, thereby obtaining a substrate.

Subsequently, a coating liquid for forming a coloring material-receiving layer, having the following formulation was coated onto one surface of the above substrate in an amount of 4.0 g/m$^2$ (on dry basis) by means of gravure reverse coating, and than dried to form a coloring material-receiving layer, whereby an image-receiving sheet was obtained.

Coating Liquid for Forming Coloring Material-Receiving Layer

| | |
|---|---|
| Ethylene-vinyl acetate copolymer ("DENKA Vinyl #1000A" manufactured by Denki Kagaku Kogyo K.K.) | 7.2 parts |
| Vinyl chloride-styrene-acrylic copolymer ("DENKA LAC#400" manufactured by Denki Kagaku Kogyo K.K.) | 1.6 parts |
| Polyester ("Vilon 600" manufactured by TOYOBO CO., LTD.) | 11.2 parts |
| Vinyl-modified silicone ("X-62-1212" manufactured by SHIN-ETSU CHEMICAL CO., LTD.) | 2 parts |
| Catalyst ("PL-50T" manufactured by SHIN-ETSU CHEMICAL CO., LTD.) | 0.02 part |
| Methyl ethyl ketone | 39 parts |
| Toluene | 39 parts |

The image-receiving sheet thus obtained was slit into a sheet having a width of 220 mm. This sheet was wound around a paper pipe having an inside diameter of 3 inches end a thickness of 7 mm with the coloring material-receiving layer outside, thereby obtaining a roll of the image-receiving sheet with an outermost periphery of 360 mm.

A lead sheet shown in Table 5 was adhered to the leading end of the image-receiving sheet by using a pressure-sensitive adhesive tape, whereby roll-type heat transfer Image-receiving sheets of Examples F1 to F11 were obtained. A roll-type image-receiving sheet without adhering any lead sheet to the leading end of the image-receiving sheet was also prepared (Comparative F1).

TABLE 5

Figure 11:
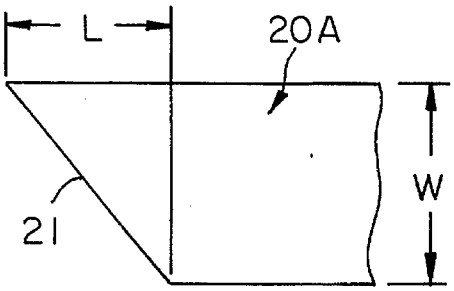
FIGS. 11 to 16 are illustrations each showing the shape of the foremost part of a lead sheet to be joined to the leading end of a heat transfer image-receiving sheet.
Figure 14:
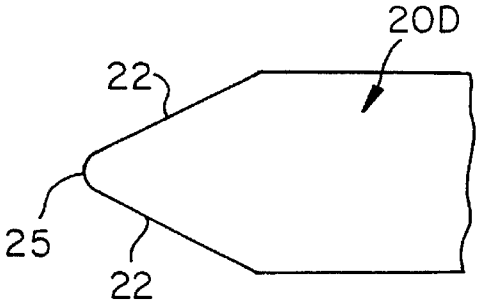

| | Shape of Foremost Part | Length of Foremost Part (cm) | Length of Non-Cut Portion (m) | Width of Foremost Part (mm) | Material, Thickness, etc. |
|---|---|---|---|---|---|
| Example F1 | FIG. 11 | 20 cm | 0.5 m | — | PET film S10*2, 25 μm |
| Example F2 | FIG. 12 | 30 cm | 0.8 m | 20 mm | PET film S10*2, 50 μm |
| Example F3 | FIG. 13 | 50 cm | 1.0 m | — | PET film S10*2, 75 μm |
| Example F4 | FIG. 14 | 60 cm | 1.2 m | — | PET film S10*2, 125 μm |
| Example F5 | FIG. 15 | 70 cm | 1.4 m | 60 mm | PET film S10*2, 188 μm |
| Example F6 | FIG. 13 | 50 cm | 1.0 m | — | white PET film*3, 125 μm |
| Example F7 | FIG. 13 | 50 cm | 1.0 m | — | PET film S10*2, 75 μm (Information was printed by gravure printing) |
| Example F8 | FIG. 13 | 50 cm | 1.0 m | 220 mm | PET film T60*2, 12 μm |
| Example F9 | FIG. 16 | none | 1.0 m | — | PET film S10*2, 125 μm |
| Example F10 | FIG. 14 | 10 cm | 1.2 m | — | PET film S10*2, 125 μm |
| Example F11 | FIG. 14 | 60 cm | 0.2 m | — | PET film S10*2, 125 μm |
| Comparative Example F1 | Having no lead sheet | | | | |

*2: PET films S10 and T60 are manufactured by Toray Industries, Inc.
*3: White PET film is "W-400" manufactured by Diafoil Hoechst Co., Ltd.

EXAMPLE F12

Paper having a thickness of 7 mm was rolled up spirally to obtain a paper-made wind-up cylinder having an inside diameter of 3 inches. The end of a PET film ("S-10" manufactured by Toray Industries, Inc., having a thickness of 100 micrometers) serving as the cushioning material was fixed to the wind-up cylinder, and wound around the cylinder in a length of 3 times the periphery of the cylinder. Thereafter, the above-obtained image-receiving sheet was joined to the PET film without overlapping their ends, by applying a commercially available adhesive cellophane tape having a thickness of 50 micrometers on both sides thereof, and then the image-receiving sheet was wound up.

The same lead sheet as in Example F1 was adhered to the leading end of the image-receiving sheet by using a pressure-sensitive adhesive tape, thereby obtaining a roll-type image-receiving sheet. The width of the image-receiving sheet was 220 mm, and the roll length was 100 m.

EXAMPLE F13

The above-obtained image-receiving sheet was slit into a sheet with a width of 110 mm, and this sheet was wound around a wind-up cylinder having an inside diameter of 1 inch aid a thickness of 3 mm. The outermost periphery of the roll obtained was 360 mm.

The wind-up cylinder used was one prepared by using paper with its surface polished. The maximum surface roughness was 38 micrometers. The maximum surface roughness was determined by using a surface roughness tester of needle type.

The same lead sheet as in Example F1 was adhered to the leading end of the image-receiving sheet by using a pressure-sensitive adhesive tape, thereby obtaining a roll-type image-receiving sheet.

The image-receiving sheets obtained in Examples F12 and F13 were evaluated in terms of unevenness of density as follows. Half-tone solid images of three colors of yellow, magenta and cyan were printed on each of the image-receiving sheets by a video printer "CP-15" manufactured by Mitsubishi Electric Corp. The images printed were visually observed as to whether unevenness of density was produced or not. As a results, no unevenness of density was found in either cases.

The roll-type image-receiving sheets obtained in Examples F1 to F13 and Comparative Example F1 were evaluated in terms of the following three items. The results are shown in Table 6.

1) Loss of Image-Receiving Sheet

The image-receiving sheet was observed as to whether or not it was damaged due to scratching or abrasion, or stained when set in the printer, and evaluated in accordance with the following standard:

©: The image-receiving sheet was not damaged due to scratching or abrasion, nor stained at all.

O: The image-receiving sheet was slightly abraded, but the printing properties were impaired.

X: The image-receiving sheet was damaged due to scratching or abrasion, or stained, and the printing properties were impaired.

2) Easiness of Setting

Each of the roll-type image-receiving sheets was set in a printer for use with a roll-type image-receiving sheet, and easiness of setting was evaluated in accordance with the following standard:

O: Setting in easy.

Δ: Setting is less easy.

X: Setting is difficult.

3) Length of Image-Receiving Sheet Stained The length (cm) of the image-receiving sheet which was stained by fingers or the paper-carrying system at the time of handling or setting in the printer.

TABLE 6

| | Loss of Image-Receiving Sheet | Easiness of Setting | Length of Image-Receiving Sheet Stained (cm) |
|---|---|---|---|
| Example F1 | ◎ | O | 0 |
| Example F2 | ◎ | O | 0 |
| Example F3 | ◎ | O | 0 |
| Example F4 | ◎ | O | 0 |
| Example F5 | ◎ | O | 0 |
| Example F6 | ◎ | O | 0 |
| Example F7 | ◎ | O | 0 |
| Example F8 | O | X | 0 |
| Example F9 | ◎ | X | 0 |
| Example F10 | ◎ | Δ | 0 |
| Example F11 | O | O | 15 |
| Example F12 | ◎ | O | 0 |

TABLE 6-continued

| | Loss of Image-Receiving Sheet | Easiness of Setting | Length of Image-Receiving Sheet Stained (cm) |
|---|---|---|---|
| Example F13 | ⊙ | ○ | 0 |
| Comp. Ex. F1 | X | X | 36 |

The results shown in Table 6 clearly demonstrate that the roll-type image-receiving sheets of Examples F1 to F7, F12 and F13 are excellent in any of the above three items. These image-receiving sheets were not damaged nor stained when they were handled or set in the printer, so that no loss was made. They are therefore particularly preferable. In the roll-type image-receiving sheets of Examples F8 to F11, the shape of the foremost part of the lead sheet, the length of the foremost part of the lead sheet, the length of the non-cut or tapered portion of the lead sheet, or the thickness of the lead sheet was somewhat inappropriate. However, they were free from loss. On the contrary, the roll-type image-receiving sheet of Comparative Example 1 was poor in easiness of setting in the printer. Moreover, it was damaged or stained when it was handled or set in the printer, and such a portion of the image-receiving sheet was wasted. The comparative image-receiving sheet is thus unfavorable.

What is claimed is:

1. A roll-type heat transfer image-receiving sheet, comprising a wind-up cylinder, and a heat transfer image-receiving sheet which comprises a substrate and a coloring material-receiving layer provided thereon, the heat transfer image-receiving sheet being wound around the wind-up cylinder, the maximum surface roughness of the wind-up cylinder with respect to a longitudinal direction thereof being 40 micrometers or less.

2. The roll-type heat transfer image-receiving sheet according to claim 1, wherein the material of the surface of the wind-tap cylinder is a plastic.

3. The roll-type heat transfer image-receiving sheet according to claim 1, wherein the end of the heat transfer image-receiving sheet is fixed to the wind-up cylinder by using a pressure-sensitive adhesive double coated tape.

4. The roll-type heat transfer image-receiving sheet according to claim 1, wherein the wind-up cylinder is made of paper.

5. The roll-type heat transfer image-receiving sheet according to claim 1, wherein the surface of the wind-up cylinder is covered with a cushioning material.

6. A roll-type heat transfer image-receiving sheet, comprising a wind-up cylinder, and a heat transfer image-receiving sheet which comprises a substrate, a foamed layer provided thereon, and a coloring material-receiving layer provided on the foamed layer, the heat transfer image-receiving sheet being wound around the wind-up cylinder, the wind-up cylinder being made of pulp as a main component, a cushioning material being provided between the wind-up cylinder and the heat transfer image-receiving sheet.

7. The roll-type heat transfer image-receiving sheet according to claim 6, wherein the cushioning material in a plastic foamed material.

8. The roll-type heat transfer image-receiving sheet according to claim 7, wherein the plastic is selected from polyurethane, polystyrene and polyethylene.

9. The roll-type heat transfer image-receiving sheet according to claim 6, wherein the cushioning material is a lead sheet of the heat transfer image-receiving sheet.

10. The roll-type heat transfer image-receiving sheet according to claim 9, wherein the length of the lead sheet is 3 times the periphery of the wind-up cylinder or more.

11. The roll-type heat transfer image-receiving sheet according to claim 9, wherein the thickness of the lead sheet is 20 micrometer or more and less than 200 micrometers.

12. The roll-type heat transfer image-receiving sheet according to claim 9, wherein the lead sheet is a polyethylene terephthalate-based film.

13. The roll-type heat transfer image-receiving amen according to claim 6, wherein the cushioning material provided on the surface of the wind-up cylinder is covered with cellulose paper.

14. The roll-type heat transfer image-receiving sheet according to claim 1, wherein the substrate is a laminate of a layer containing microvoids and a support, the layer containing microvoids being adjacent to the coloring material-receiving layer.

15. The roll-type heat transfer image-receiving sheet according to claim 14, wherein the heat transfer image-receiving sheet in wound around the wind-up cylinder with the coloring material-receiving layer facing outside.

16. The roll-type heat transfer image-receiving sheet according to claim 14, wherein the layer containing microvoids is a polypropylene-based plastic film, and at least a part of the support is made of paper.

17. The roll-type heat transfer image-receiving sheet according to claim 14, wherein the modulus of elasticity at 20° C. and 50 RH% of the layer containing microvoids (Eb) is lower than that of the support (Es) (Eb <Es).

18. The roll-type heat transfer image-receiving sheet according to claim 14, wherein the degree of thermal shrinkage at 110° C. of the layer containing microvoids (Sb) is higher than that of support (Ss) (Sb>Ss).

19. The roll-type heat transfer image-receiving sheet according to claim 14, wherein the wind-up cylinder has an outside diameter of 100 mm or less.

20. The roll-type heat transfer image-receiving sheet according to claim 1, wherein the leading end of the heat transfer image-receiving sheet is partly cut, and the width of the foremost part of the cut portion is from 0% to 90% of that or the heat transfer image-receiving sheet.

21. The roll-type heat transfer image-receiving sheet according to claim 20, wherein the length of the foremost cut portion in the longitudinal direction thereof is from 5% to 300% of the width of the heat transfer image-receiving sheet.

22. The roll-type heat transfer image-receiving sheet according to claim 20, wherein a leading end of the heat transfer image-receiving sheet is cut obliquely.

23. The roll-type heat transfer image-receiving sheet according to claim 1, wherein the reflecting properties of at least a part of the surface of the wind-up cylinder are different from those of at least one surface of the heat transfer image-receiving sheet.

24. The roll-type heat transfer image-receiving sheet according to claim 23, wherein the reflecting properties of at least a part of the surface of the wind-up cylinder are different from those of at least one of the surface on which the coloring material-receiving layer is formed and the surface on which the coloring material-receiving layer is not formed.

25. The roll-type heat transfer image-receiving sheet according to claim 23, wherein a lead sheet is provided to the terminal end of the heat transfer image-receiving sheet, and the reflecting properties of at least a part of the surface of the wind-up cylinder are different from those of at least one surface of the lead sheet.

26. The roll-type heat transfer image-receiving sheet according to claim 23, wherein the wind-up cylinder is covered with cellulose paper.

27. The roll-type heat transfer image-receiving sheet according to claim 23, wherein a polymer film is adhered to at least a part of the surface of the wind-up cylinder.

28. The roll-type heat transfer image-receiving sheet according to claim 23, wherein the surface of the wind-up cylinder is black.

29. The roll-type heat transfer image-receiving sheet according to claim 23, wherein the surface reflectivity of the wind-up cylinder to light having a wavelength of 600 to 1200 nm is 70% or less.

30. The roll-type heat transfer image-receiving sheet according to claim 1, wherein a lead sheet is provided to the leading end of the heat transfer image-receiving sheet.

31. The roll-type heat transfer image-receiving sheet according to claim 30, wherein the foremost part of the lead sheet is cut so that the width of the end will be from 0% to 90% of the width of the heat transfer image-receiving sheet.

32. The roll-type heat transfer image-receiving sheet according to claim 31, wherein the length of the foremost cut portion of the lead sheet in the longer direction thereof is 0.5 times the width of the heat transfer image-receiving sheet or more and 10 times the width of the heat transfer image-receiving sheet or less.

33. The roll-type heat transfer image-receiving sheet according to claim 31, wherein the length of the non-cut portion of the lead sheet is one time the outermost periphery of the roll of the heat transfer image-receiving sheet or more, and 10 times the outermost periphery of the roll of the heat transfer image-receiving sheet or less.

34. The roll-type heat transfer image-receiving sheet according to claim 30, wherein the lead sheet has transparency.

35. The roll-type heat transfer image-receiving sheet according to claim 30, wherein information concerning the heat transfer image-receiving sheet and a printer to be used therewith is indicated on the surface of the lead sheet.

36. The roll-type heat transfer image-receiving sheet according to claim 30, wherein the thickness of the lead sheet is 20 micrometers or more, and 200 micrometers or less.

* * * * *